US005336590A

United States Patent [19]

Mitsui

[11] Patent Number: 5,336,590

[45] Date of Patent: Aug. 9, 1994

[54] SILVER HALIDE PHOTOGRAPHIC PHOTOSENSITIVE MATERIALS

[75] Inventor: Akio Mitsui, Kanagawa, Japan

[73] Assignee: Fuji Photo Film Co., Ltd., Kanagawa, Japan

[21] Appl. No.: 952,157

[22] Filed: Sep. 28, 1992

Related U.S. Application Data

[63] Continuation of Ser. No. 596,665, Oct. 11, 1990, abandoned.

[30] Foreign Application Priority Data

Oct. 12, 1989 [JP] Japan ..... 1-265698
Jun. 28, 1990 [JP] Japan ..... 2-170834

[51] Int. Cl.[5] ..... G03C 7/22

[52] U.S. Cl. ..... 430/547; 430/378; 430/406; 430/589; 430/940

[58] Field of Search ..... 430/378, 406, 547, 549, 430/552, 553, 554, 555, 558, 589, 598, 940

[56] References Cited

U.S. PATENT DOCUMENTS

| | | | |
|---|---|---|---|
| 4,139,387 | 2/1979 | von Konig et al. | 430/598 |
| 4,163,670 | 8/1979 | Shiba et al. | 430/562 |
| 4,191,576 | 3/1980 | Fuseya et al. | 430/613 |
| 4,634,653 | 1/1987 | Toya et al. | 430/598 |
| 4,666,825 | 5/1987 | Shimba et al. | 430/393 |
| 4,704,349 | 11/1987 | Kriebel | 430/406 |
| 4,741,990 | 5/1988 | Sakamoto et al. | 430/489 |
| 4,764,454 | 8/1988 | Ichijima et al. | 430/378 |
| 4,828,973 | 5/1989 | Hirano et al. | 430/598 |
| 4,871,658 | 10/1989 | Sakamoto et al. | 430/551 |
| 4,914,009 | 4/1990 | Ueda et al. | 430/393 |
| 4,985,351 | 1/1991 | Matejec et al. | 430/598 |
| 5,030,553 | 7/1991 | Kuwashima et al. | 430/598 |
| 5,128,237 | 7/1992 | Kimura et al. | 430/378 |

*Primary Examiner*—Hoa Van Le
*Attorney, Agent, or Firm*—Sughrue, Mion, Zinn, Macpeak & Seas

[57] ABSTRACT

A silver halide color photographic photosensitive material is disclosed which comprises a transparent support on which there are provided at least one cyan color forming coupler containing layer, at least one magenta color forming coupler containing layer, and at least one yellow color forming coupler containing layer, and at least one light-insensitive layer, wherein a compound represented by formula (I), a compound represented by formula (IIa) or (IIb) or both, and an internal latent image forming silver halide grain are contained in the photographic material:

(I)

wherein $Z^{11}$ represents a group of non-metal atoms which is required to form a five or six membered heterocyclic ring, and $Z^{11}$ may be substituted with substituent groups; $R^{11}$ is an aliphatic group; and $R^{12}$ is a hydrogen atom, an aliphatic group or an aromatic group; $R^{11}$ and $R^{12}$ may be substituted with substituent groups; $R^{12}$ may be joined to the heterocyclic ring completed by $Z^{11}$ to form a ring; provided that at least one of the groups $R^{11}$, $R^{12}$ and $Z^{11}$ contains an alkyl group, an acyl group, a hydrazine group or a hydrazone group, $R^{11}$ and $R^{12}$ may be combined to form a dihydropyridinium skeleton; moreover, at least one of the groups $R^{11}$, $R^{12}$ and $Z^{11}$ may have a group which promotes adsorption on silver halide; and $Y^{11}$ is a charge balancing counter ion and n is 0 or 1:

(IIa)

(Abstract continued on next page.)

-continued

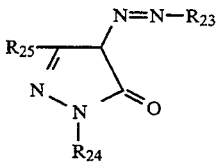

(IIb)

wherein $R_{21}$, $R_{22}$ and $R_{23}$ each represents an aliphatic group, an aromatic group, or a heterocyclic group; $R_{25}$ represents an aniline group or an acylamino group; $R_{24}$ represents a substituted phenyl group; $X^{21}$ represents a linkage group and $X^{21}$ may not exist; $R_{26}$ represents a group which can be substituted on a benzene ring; and m represents an integer of 0 to 4.

16 Claims, No Drawings

SILVER HALIDE PHOTOGRAPHIC PHOTOSENSITIVE MATERIALS

This is a continuation of application Ser. No. 07/596,665, filed Oct. 11, 1990, now abandoned.

FIELD OF THE INVENTION

The present invention relates to superior silver halide color photographic photosensitive materials with which dupe negative photographs of high image quality can be obtained easily.

BACKGROUND OF THE INVENTION

In the field of cinematography, positive films used for projection are generally produced using the method described below. Filming is carried out using a color negative film for cinematographic purposes to thereby obtain a master negative. Next, the master negative is exposed on a dupe material and a plurality of dupe negatives are made. Positive films for cinema use are then prepared by exposing the number of positive films required for cinematographic purposes using the dupe negative film. Direct exposure of the positive films for cinema use using the master negative is not carried out to ensure that the precious master negative is not damaged during the exposure of the large number of copies which have to be made. This procedure has been described in detail by L. Bernard Happe in *Basic Motion Picture Technology*, pages 280 to 303, Focal Press, 1975, and on pages 1 to 10 and 124 to 131 of the Japanese Cinematography and Television Technical Association publication *Professional Cine and TV Technical Manual*, 1989/1990.

The two types of materials indicated below are used for the dupe materials in such a procedure. The first type of material is referred to as a color intermediate material for cinematographic purposes and is typified by Eastmancolor 5243 (made by the Eastman Kodak Co., USA) and Fujicolor Intermediate 8213 (made by the Fuji Photo Film Co., Ltd.). These are ultra-fine grained negative type films for print purposes and they can be developed in the same processing machines as cinematographic negative materials. Development processing is described more specifically as the process ECN-2 in volume 1 of the Eastman Kodak publication *Manual for the Processing of Eastman Color Films*. A positive image with masking is obtained on exposing the master negative onto the intermediate material and a dupe negative can then be obtained by exposing once again onto the intermediate material. This method has the advantage of enabling the negative film processors already installed in the cinematographic film processing house to be used, but the dupe material has to be used twice and, as well as being complicated and expensive, there is a serious disadvantage in terms of the deterioration which arises in image quality.

The other type of dupe material is a color reversal intermediate material. This is typified by Eastmancolor 5249 from the Eastman Kodak Co. This is an ultra-fine grain print reversal type film and it is developed and processed in a special reversal processor. The development of this material has been described in more detail in the Eastman Kodak publication *Manual for the Processing of Eastmancolor Reversal Intermediate Film Using Process CRI*-1. Dupe negatives can be made with a single reversal processing operation when the master negative is exposed onto a reversal intermediate material. There is an advantage in respect of image quality and cost when such a method is used since only one exposure is involved, but it is necessary to install a new processor and, as well as using more space and involving more expense, the developers of this type are difficult to control and much effort is required to maintain a constant image quality. Because of these disadvantages, this type of material is not used as widely as the former type of material.

On the other hand, the use of direct positive type photosensitive materials has been considered as a means of obtaining direct positive images from positive images easily. The direct positive photosensitive materials include solarization type and Herschel effect type materials, which employ pre-fogged emulsions; and light fogging types, types with which a developer which contains a nucleating agent is used, and types in which a nucleating agent is incorporated into the material, which employ emulsions which have not been pre-fogged. These have been described, for example, by T. H. James in *The Theory of the Photographic Process*, Fourth Edition, Chapter 7, pages 182 to 193. Methods in which internal latent image type emulsions from among the emulsions which have not been pre-fogged are used have been disclosed in *Research Disclosure* volume 151, No. 15162 (published November 1976) pages 72 to 87, and in U.S. Pat. Nos. 2,592,250, 2,466,957, 2,497,875, 2,588,982, 3,317,322, 3,761,266, 3,761,276 and 3,796,577, British Patents 1,151,363, 1,150,553 and 1,011,062, JP-A-63--8741 and JP-A-63-146035. (The term "JP-A" as used herein signifies an "unexamined published Japanese patent application.") In these documents the direct positive materials are described in terms of their role as materials for obtaining direct positive images from positive images. However, no method for obtaining direct dupe negatives from negative images in such as way as to solve the problems of the present invention has been described in these publications. It is disclosed in JP-A-64-44940, for example, that colored couplers can be used conjointly with internal latent image type silver halide grains, but there is no specific example and there is no mention of the new problems such as the worsening of the stability of the photosensitive material which is caused by the conjoint use of colored couplers and there is no mention of any means for resolving these problems. Moreover, there are new problems which arise on processing with the processing agents for cinematographic negative films. These include, for example, color forming failure and de-silvering failure with iodine containing processing baths (for example, color development baths and bleach baths), and occurrence of bleach staining and retarded de-silvering rates due to the use of persulfate bleaching agents, etc. These problems cannot be anticipated from the known data indicated above, and no means have been proposed for overcoming these problems.

SUMMARY OF THE INVENTION

A first object of the invention is to provide a novel method for obtaining dupe negatives of high image quality both easily and cheaply.

A second object of the invention is to provide a silver halide photosensitive material which contains colored couplers and internal latent image type silver halide emulsions which have improved stability.

As a result of thorough research carried out with a view to achieving these objects, the inventors have discovered that they may be realized effectively and unexpectedly with specified photosensitive materials which are described in detail below, and the invention is based upon these findings.

The objects of the invention have been realized by means of a silver halide color photographic photosensitive material comprised of a transparent support on which there are provided at least one cyan color forming coupler containing layer, at least one magenta color forming coupler containing layer, at least one yellow color forming coupler containing layer, and at least one light-insensitive layer, wherein a compound represented by formula (I), a compound represented by formula (IIa) or (IIb) or both, and an internal latent image forming silver halide grain are contained in the photographic material:

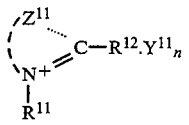

(I)

wherein $Z^{11}$ represents a group of non-metal atoms which is required to form a five or six membered heterocyclic ring, and $Z^{11}$ may be substituted with substituent groups, $R^{11}$ is an aliphatic group, and $R^{12}$ is a hydrogen atom, an aliphatic group or an aromatic group; $R^{11}$ and $R^{12}$ may be substituted with substituent groups; $R^{12}$ may be joined to the heterocyclic ring completed by $Z^{11}$ to form a ring; provided that at least one of the groups $R^{11}$, $R^{12}$, and $Z^{11}$ contains an alkyl group, an acyl group, a hydrazine group or a hydrazone group, or $R^{11}$ and $R^{12}$ may be combined to form a six membered dihydropyridinium skeleton; at least one of the groups $R^{11}$, $R^{12}$ and $Z^{11}$ may have a group which promotes adsorption on silver halide; $Y^{11}$ is a charge balancing counter ion and n is 0 or 1:

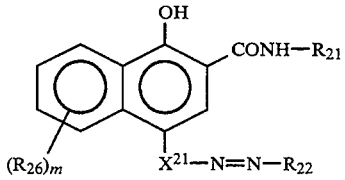

(IIa)

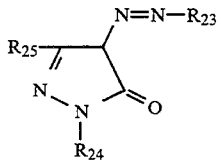

(IIb)

wherein $R_{21}$, $R_{22}$ and $R_{23}$ each represents an aliphatic group, an aromatic group or a heterocyclic group; $R_{25}$ represents an aniline group or an acylamino group; $R_{24}$ represents a substituted phenyl group; $X^{21}$ represents a linking group; $R_{26}$ represents a group which can be substituted onto an aromatic ring; and m represents an integer of value from 0 to 4.

Silver halide color photosensitive materials which have improved stability, especially fresh storage properties and latent image storage properties, and which have good print timing are obtained by adopting the construction of the present invention.

DETAILED DESCRIPTION OF THE INVENTION

It is possible by the means outlined above to obtain dupe negatives of high picture quality easily and in a stable manner with a single exposure and development processing operation. Moreover, there is no need for special processing facilities since these materials can be used in conjunction with existing processing operations and a saving in space is also achieved.

The colored couplers which can be used in the present invention are used with a view to matching the printing conditions to the positive film and with a view to color correction by the formation of a mask of more or less the same color as the negative master in the dupe negative when forming the dupe negative from the master film.

"Colored coupler" means a compound capable of releasing a colored compound which has a chromophore upon reaction with an oxidation product of a developing agent.

The compounds disclosed in *Research Disclosure* No. 17643, section VII-G, U.S. Pat. Nos. 4,163,670, 4,004,929 and 4,138,258, JP-B-57-39413 and British Patent 1,146,368 can be used as colored couplers. (The term "JP-B" as used herein signifies an "examined Japanese patent publication.")

The compounds of this invention represented by formulae (IIa) and (IIb) are a subgroups of the compounds mentioned above. The compounds of formulae (IIa) and (IIb) have an appropriate reactivity, a suitable hue, and a high solubility, and can be incorporated in a photographic material. Futhermore, it is preferable that the preservability of a dupe negative material of the present invention does not deteriorate due to unnecessary interaction with the nucleating agent which is included in the compounds of formula (I). The inventors' research has shown that among the colored couplers, the colored coupler compounds represented by formulae (IIa) and (IIb) provide less interaction with the nucleating agent which is included in formula (I) when used in a dupe negative material.

The compounds represented by formulae (IIa) and (IIb) are further explained below.

In formulae (IIa) and (IIb), an "aliphatic group" signifies a saturated or unsaturated, linear or cyclic, linear chain or branched, substituted or unsubstituted aliphatic hydrocarbyl group which has from 1 to 32, preferably from 1 to 22, carbon atoms. Typical examples include the methyl, ethyl, propyl, isopropyl, butyl , tert-butyl, iso-butyl, tert-amyl, hexyl, cyclohexyl, 2-ethylhexyl, octyl, 1,1,3,3-tetramethylbutyl, decyl, dodecyl, hexadecyl and octadecyl groups.

An "aromatic group" signifies a substituted or unsubstituted phenyl group, or a substituted or unsubstituted naphthyl group, which has from 6 to 20 carbon atoms.

A "heterocyclic group" signifies preferably a from three to eight substituted or unsubstituted heterocyclic group which has from 1 to 20, preferably form 1 to 7, carbon atoms and having a hetero atom selected from among nitrogen, oxygen and sulfur atoms. Typical examples of heterocyclic groups include the 2-pyridyl, 2-thienyl, 2-furyl, 1-imidazolyl, 1-indolyl, phthalimido, 1,3,4-thiadiazol-2-yl, 2-quinolyl, 2,4-dioxo-1,3-imidazolidin-5-yl, 2,4-dioxo-1,3-imidazolidin-3-yl, succinimido, 1,2,4-triazol-2-yl and 1-pyrazolyl groups.

The groups indicated below are especially desirable among the substituent groups represented by $R_{25}$.

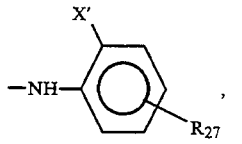

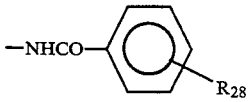

Here, X′ represents a halogen atom or a substituted or unsubstituted alkoxy group which has from 1 to 18 carbon atoms. $R_{27}$ and $R_{28}$ represent a hydrogen atom, a halogen atom, an alkyl group, an alkoxy group, an acylamino group, a sulfonamido group, a sulfamoyl group, a carbamoyl group, a diacylamino group, an alkoxycarbonyl group, an alkoxysulfonyl group, an aryloxysulfonyl group, an alkanesulfonyl group, an arylsulfonyl group, an alkylthio group, an arylthio group, an alkyloxycarbonylamino group, an alkylureido group, an acyl group, a nitro group, a carboxyl group or a trichloromethyl group, and these groups are used in the sense that they include those which are substituted with substituent groups. The carbon number of these groups which can be defined by a carbon range is up to 18.

$R_{24}$ represents a phenyl group which is substituted with at least one group selected from among a halogen atom, an alkyl group, an alkoxy group, an alkoxycarbonyl group and a cyano group. The carbon number of these alkyl, alkoxy and alkoxycarbonyl groups is 1 to 23.

$R_{21}$ may be, for example, a dodecyl group, a 2-(2-hexyldecyloxy)phenoxy group, a hexadecyl group, a cyclohexyl group, a 2-tetradecyloxyphenyl group, a 3-(2,4-di-tert-amylphenoxy)propyl group, a 4-(2,4-di-tertamylphenoxy)butyl group, a 3-dodecyloxypropyl group, a tert-butyl group, a butyl group, a 2-methoxy-5-dodecyloxycarbonylphenyl group, or a 1-naphthyl group.

$R_{26}$ may be, for example, an isobutyloxycarbonylamino group, a ethoxycarbonylamino group, a phenylsulfonylamino group, a methanesulfonamido group, a benzamido group, a trifluoroacetamido group, a 3-phenylureido group, a butoxycarbonylamino group, or an acetamido group.

$R_{22}$ and $R_{23}$ may each be, for example,

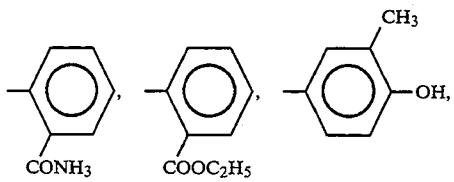

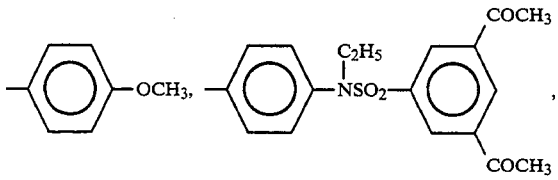

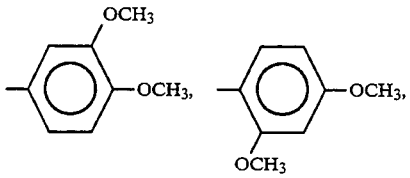

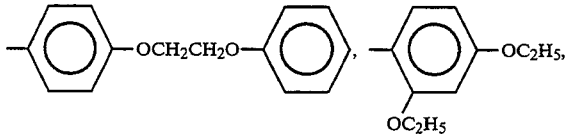

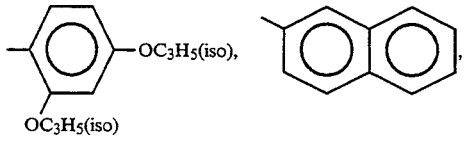

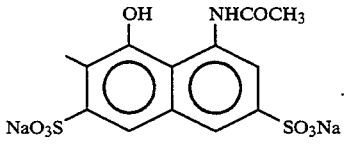

$X^{21}$ may be, for example,

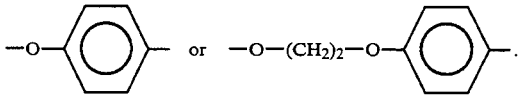

Actual examples of compounds which can be represented by general formulae (IIa) and (IIb) are indicated below, but such compounds are not limited to these examples.

(IIa-1)
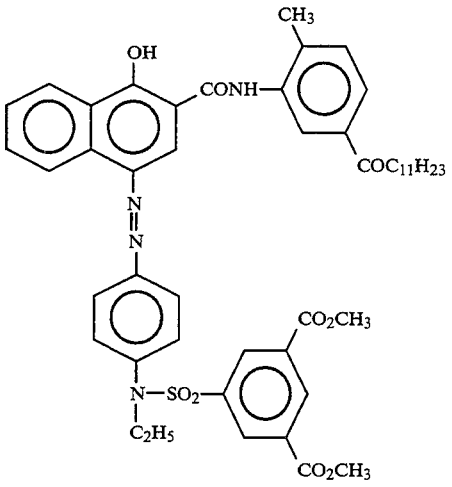
(IIa-2)
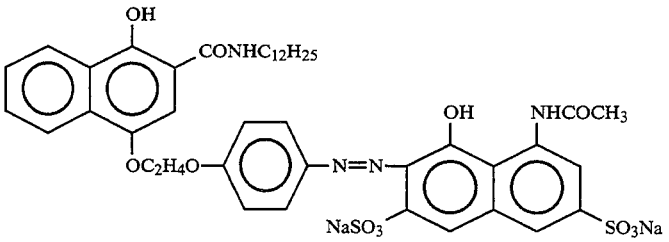
(IIa-3)
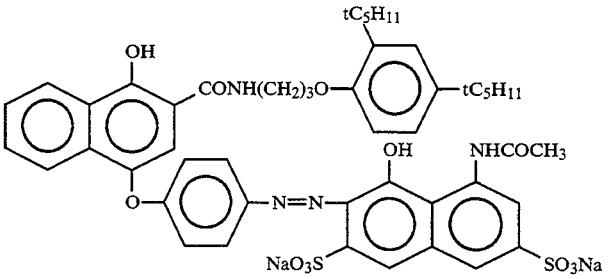
(IIa-4)
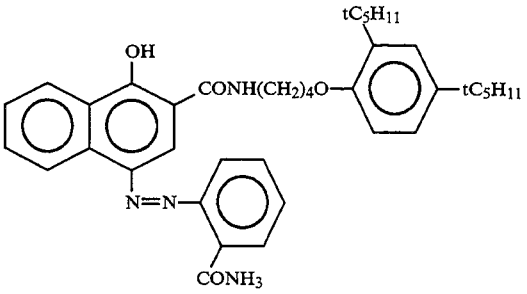
(IIa-5)
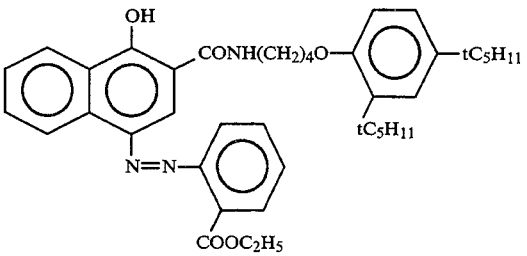

-continued
(IIA-6)
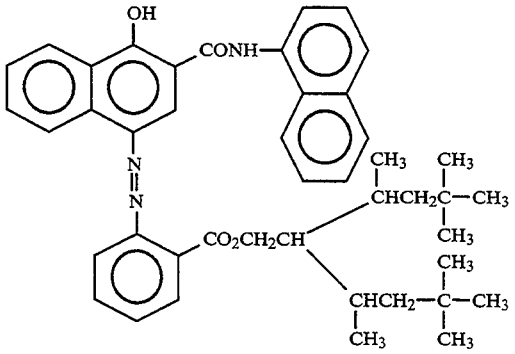
(IIb-1)
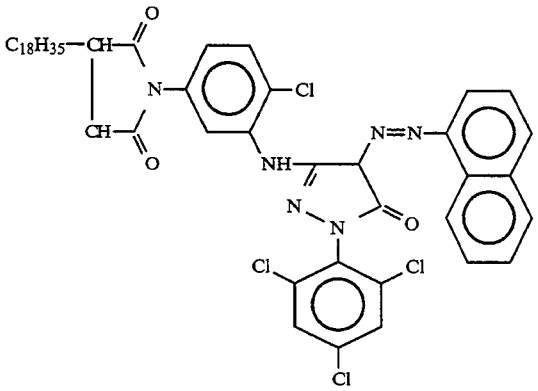
(IIb-2)
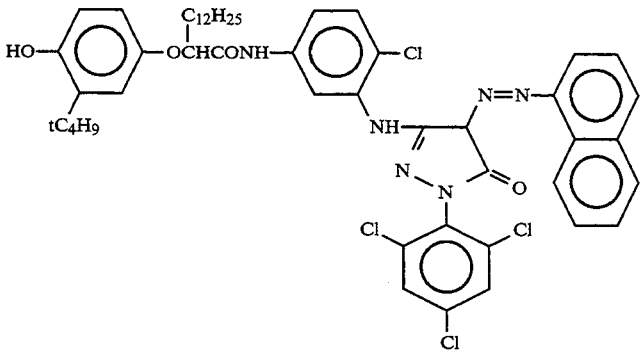
(IIb-3)
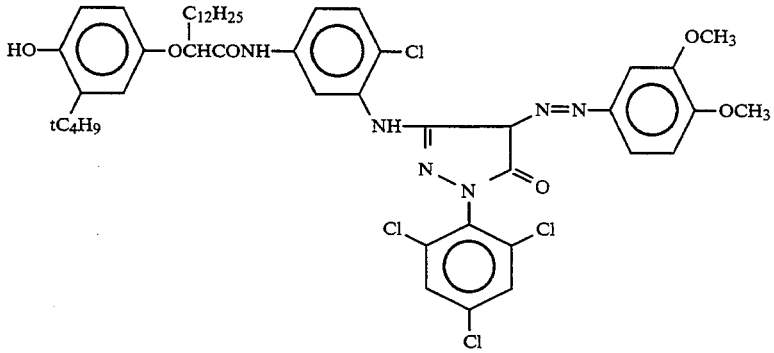

-continued
(IIb-4)
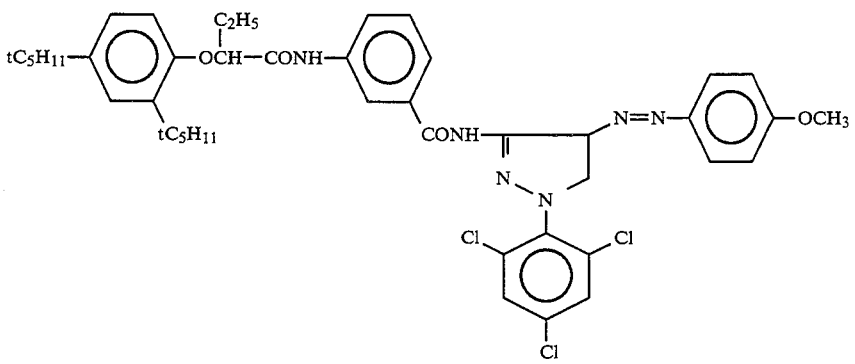
(IIb-5)
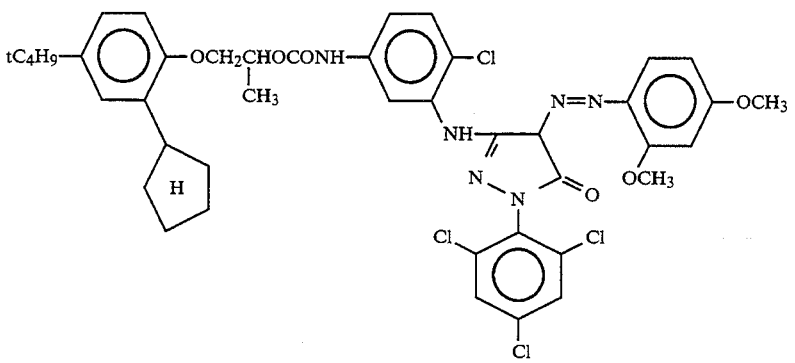
(IIb-6)
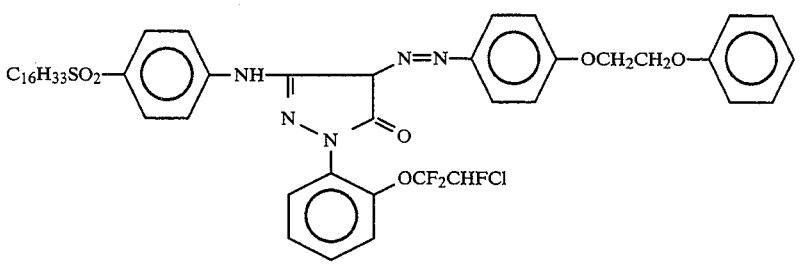
(IIb-7)
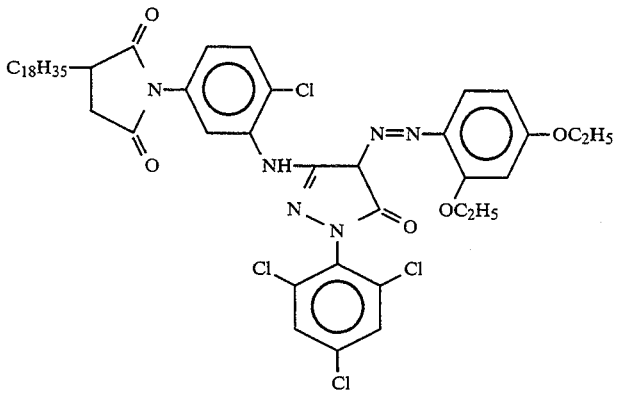

-continued (IIb-8)

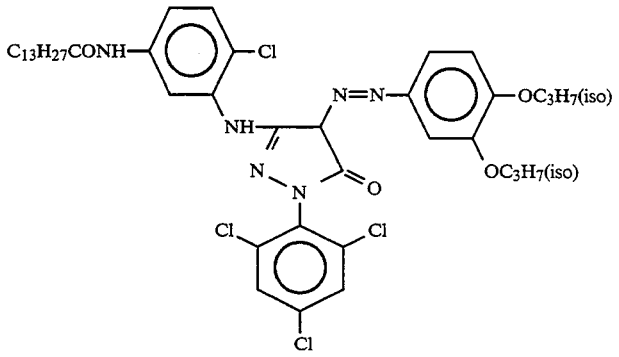

(IIb-9)

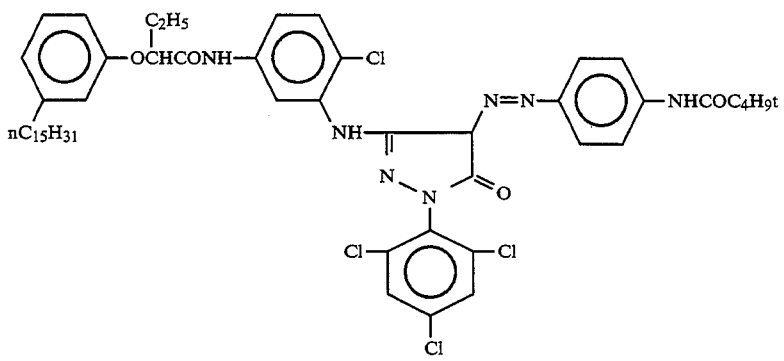

(IIb-10)

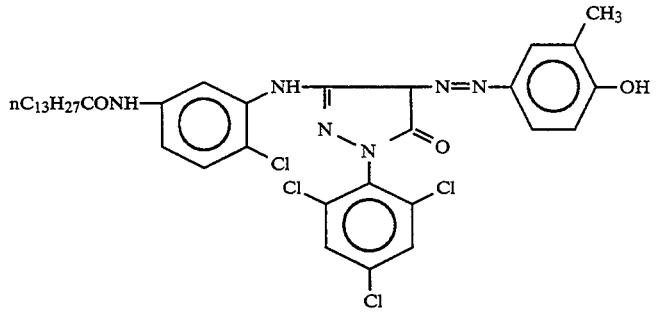

(IIb-11)

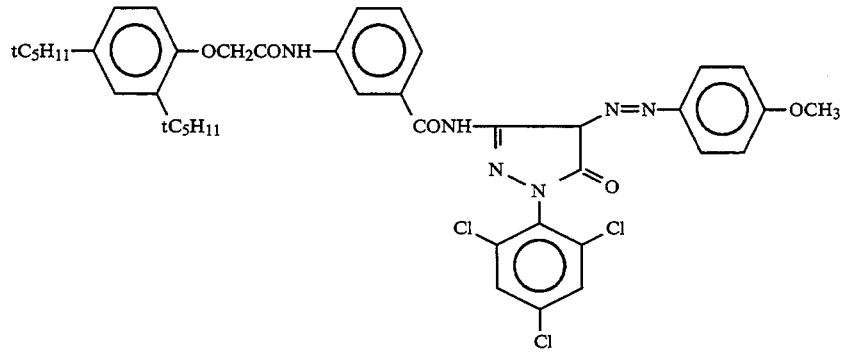

The compound represented by formula (IIa) or (IIb) can be synthesized in accordance with, for example, JP-B-57-39143, and U.S. Pat. Nos. 3,034,892 and 3,476,563.

The total amount of the compounds of formulae (IIa) and (IIb) used in the present invention is 1.0 g/m$^2$ to 0.05 g/m$^2$, and preferably 0.06 g/m$^2$ to 0.1 g/m$^2$, of photographic material.

It is preferred that the color hue of the colored couplers of formulae (IIa) and (IIb) be yellow and/or magenta. The peak wavelength in the spectral absorption spectrum of the compounds of formula (IIa) or (IIb) is preferably 400 nm to 560 nm.

The colored coupler of formulae (IIa) or (IIb) is preferably added to a magenta color forming coupler containing layer, a cyan color forming coupler containing layer, and an adjacent light-insensitive layer thereof, with a green-sensitive magenta color forming coupler containing layer and a red-sensitive cyan color forming coupler containing layer being particularly preferred.

For example, it is preferred to use a yellow colored coupler in a green-sensitive layer. In this case, the addition amount of the colored coupler can be decided by adjusting a density to a value which is nearly the same as the density measured by a blue filter at the point in which the green-sensitive layer is colored to maxium density of magenta, In this context, nearly the same means 30 % to 200 mol % to the mol number of color forming coupler in the layer. In addition, in a red-sensitive layer, it is preferred to co-use a yellow colored coupler and a magenta colored coupler. The amount of these colored couplers can also be decided by the same manner as the green-sensitive layer.

The internal latent image type silver halide emulsions used in the invention are emulsions in which the surface of the silver halide grains has not been pre-fogged and which contain silver halides with which the latent image is for-med principally within the grains. In more practical terms, they are silver halide emulsions with which, when coated at a fixed rate (0.5 to 3 g/m$^2$) on a transparent support, the maximum density measured using the normal method for measuring photographic density after exposing for a fixed time of from 0.01 to 10 seconds and developing for 5 minutes at 18° C. in the developer A (an internal type developer) indicated below is at least five times, and most desirably at least ten times, the maximum density obtained on coating and exposing the emulsion in the same way as before and developing the silver halide emulsion for 6 minutes at 20° C. in developer B (a surface type developer) indicated below.

| | |
|---|---|
| Internal Developer A | |
| Metol | 2 grams |
| Sodium sulfite (anhydrous) | 90 grams |
| Hydroquinone | 8 grams |
| Sodium carbonate (mono-hydrate) | 52.5 grams |
| KBr | 5 grams |
| KI | 0.5 gram |
| Water to make up to | 1 liter |
| Surface Developer B | |
| Metol | 2.5 grams |
| L-Ascorbic acid | 10 grams |
| $NaBO_2.4H_2O$ | 35 grams |
| KBr | 1 gram |
| Water to make up to | 1 liter |

Actual examples of internal latent image type emulsions include, for example, the conversion type silver halide emulsions disclosed in U.S. Pat. No. 2,592,250 and the core/shell type silver halide emulsions disclosed in U.S. Pat. Nos. 3,317,322, 3,761,276, 3,850,637, 3,923,513, 4,035,185, 4,395,478 and 4,504,570, JP-A-52-156614 , JP-A-55-127549 , JP-A-53-60222, JP-A-56-22681, JP-A-59-208540, JP-A-60-107641, JP-A-61-3137, JP-A-62-215272 and in the patents disclosed on page 236 of *Research Disclosure*, No. 23510 (published November 1983).

The preferred halogen composition of the internal latent image type and core/shell type silver halide grains of the present invention is that of a silver bromide, a silver chlorobromide, a silver chloride, or a silver iodobromide or silver iodochlorobromide which contains not more than 10 mol % of iodine.

The halogen composition may or may not be uniform within the grains. Pure silver bromide and silver chlorobromides in which the silver chloride content is at least 30 mol % are especially preferred.

In the present invention, at least two types of core grains are mixed, and the average size of the core grains before mixing is preferably from 0.05 μm to 2 μm, and mono-disperse emulsions of which the variation coefficients are not more than 20% are preferred. Emulsions in which the variation coefficient is not more than 15% are especially preferred.

The average size of the core grains which are mixed may be the same, but a difference in size of at least 10% is preferred.

The average grain size of the final complete emulsion is preferably from 0.1 μm to 3 μm.

The crystal phase of the core grains may be cubic, octahedral, cubic with the corners missing, octahedral with the corners missing, spherical or tabular. Grains which have a (100) plane and/or a (111) plane are especially preferred. The crystal phase of the final completed grains may be cubic, octahedral, cubic or octahedral with the corners missing, and spherical or tabular grains with an aspect ratio of from 3 to 30 are preferred.

Sulfur-containing silver halide solvents are preferably included when forming the core grains and/or during the metal ion doping or chemical sensitization treatment.

The aforementioned silver halide solvents are defined as follows for practical purposes. A compound is considered to be a silver halide solvent if a 0.02 molar solution of the mixture (e.g., water/methanol=1/1) at 60° C. will dissolve more than twice the amount of silver chloride which would dissolve without the silver halide solvent.

Actual examples of sulfur containing silver halide solvents include thiocyanate, organic thioether compounds, thione compounds and mercapto compounds, and in practice use can be made of the compounds disclosed on pages 245 to 249 of JP-A-60-136736, the compounds disclosed on pages 195 to 196 of JP-A-55-77737, or the thione compounds or thioether compounds disclosed in JP-A-53-824008 and JP-A-53-144319.

The use of so-called deactivating agents (oxidizing agent) which reduce the activity of the silver halide solvents is desirable in the manufacture of emulsions of the present invention.

The deactivating agents used in this invention are compounds which reduce or remove completely the action of the silver halide solvent, and any such substances can be used provided that they do not have an adverse effect on the photographic properties.

Inorganic oxidizing agents and organic oxidizing agents can be used as deactivating agents.

Actual examples of deactivating agents are indicated below.

For example, hydrogen peroxide (aqueous), adducts of hydrogen peroxide (for example, $NaBO_2.H_2O_2.3H_2O$, $2NaCO_3.3H_2O_2$, $Na_4P_2O_7.2H_2O_2$, $2NaSO_4.H_2O_2.2H_2O$), salts of peroxyacids (for example, $K_2S_2O_8$, $K_2C_2O_6$, $K_4P_2O_8$), peroxycomplex compounds (for example, $K_2[Ti(O_2)C_2O_4].3H_2O$, $Na_3[VO(O_2)(C_2O_4)_2].6H_2O$), and salts of oxygen acids such as permanganates (for example $KMnO_4$) and chromates (for example, $K_2Cr_2O_7$) can be used as inorganic oxidizing agents; and organic peroxides (for example, peracetic acid, perbenzoic acid) can be used as organic oxidizing agents.

The amount of the silver halide solvent which is used in the invention added is determined freely according to the type of material used and the time of its addition, but it is preferably from $10^{-8}$ mol to $10^{-1}$ mol, and most desirably from $10^{-8}$ mol to $10^{-2}$ mol, per mol of silver halide.

The silver halide solvent and deactivating agent may be dissolved in water or in a water soluble organic solvent (for example, alcohols, ethers, glycols, ketones, esters, amides) for addition.

The time for the addition of the deactivating agent may be before or after the addition of the silver halide solvent, but it is preferably added after the addition of the silver halide solvent.

The preferred metal ions for use when doping with metal ions as mentioned above are cadmium, zinc, lead, thallium, iridium, rhodium and iron. These metal ions can be used in methods where they are introduced as metal salts or metal complex salts prior to, or during, the formation of the silver halide grains of the internal cores, or during the physical ripening of the silver halide grains of the internal cores.

The metal ions are generally used in a proportion of at least $10^{-6}$ mol per mol of silver halide. The silver halide of the internal cores may be chemically sensitized using one or more types of heavy metal sensitizing agent, sulfur sensitizing agent or reduction sensitizing agent instead of, or together with, the doping of metal ions described above. The use of gold sensitization and sulfur sensitization is especially preferred.

Methods for treating the silver halide of such a core and of forming a shell on the surface of the grains of silver halide from which the cores are formed are well known, and use can be made of those disclosed, for example, in U.S. Pat. Nos. 3,206,316, 3,317,322, 3,367,778 (excluding the process in which the grain surface is fogged), and 3,761,276.

The thickness of the shell is preferably at least 0.03 microns but not more than 1 micron.

The grain surface of the core/shell type silver halide prepared in the way described above is chemically sensitized in the way described below.

Chemical sensitization of the core/shell type silver halide grain surface can be carried out using known methods such as those described, for example, by Glafkides in *Chimie et Physique Photographique*, published by Paul Montel, 1967, by V. L. Zelikman et al. in *Making and Coating Photographic Emulsions*, published by The Focal Press, 1964 or by H. Frieser in *Die Grundlagen der Photographischen Prozesse mit Silberhalogeniden*, published by Akademische Verlagsgesellschaft, 1968.

The surface chemical sensitization is preferably carried out using a gold and/or sulfur sensitization procedure.

A nucleating agent represented by formula (I) is explained in detail hereinafter.

The nucleating agent used in those cases in the present invention in which the chemical fogging method is used can be included in the photosensitive material or in the processing bath for the photosensitive material. It is most preferably included in the photosensitive material.

Here, a nucleating agent is a substance which acts in such a way that a direct positive image is formed when an internal latent image type silver halide emulsion which has not been pre-fogged is being subjected to a surface development process. A fogging process in which a nucleating agent is used is especially preferable in the present invention.

When included in the photosensitive material, the nucleating agent is preferably added to the internal latent image type silver halide emulsion layer, but provided that it diffuses during coating or during processing and becomes adsorbed on the silver halide, the nucleating agent may be added to another layer, such as an intermediate layer, an under layer or a backing layer.

In those cases where the nucleating agent is added to a processing bath it may be included in the development bath or in a low pH pre-bath such as that disclosed in JP-A-58-178350.

Furthermore, two or more types of nucleating agent can be used conjointly.

Disclosures have been made in JP-A-63-106656 in connection with nucleating agents which can be used in the present invention, and the use of the compounds indicated as (N-I) and (N-II) in that specification is especially preferable.

The nucleating agents most desirably used in the present invention can be represented by the general formula (I) indicated below:

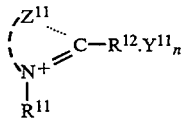

(I)

In formula (I), $Z^{11}$ represents a group of non-metal atoms which is required to form a five or six membered heterocyclic ring, and $Z^{11}$ may be substituted with substituent groups. $R^{11}$ is an aliphatic group, and $R^{12}$ is a hydrogen atom, an aliphatic group or an aromatic group. $R^{11}$ and $R^{12}$ may be substituted with substituent groups. Furthermore, $R^{12}$ may be joined to the heterocyclic ring completed by $Z^{11}$ to form a ring. However, at least one of the groups $R^{11}$, $R^{12}$, and $Z^{11}$ contains an alkyl group, an acyl group, a hydrazine group or a hydrazone group, or $R^{11}$ and $R^{12}$ may be combined to form a six membered dihydropyridinium skeleton. Moreover, at least one of the groups $R^{11}$, $R^{12}$ and $Z^{11}$ may have a group which promotes adsorption on silver halide. $Y^{11}$ is a charge balancing counter ion and n is 0 or 1.

More precisely, the heterocyclic ring which is completed by $Z^{11}$ is, for example, a quinolinium nucleus, a benzothiazolium nucleus, a benzimidazolium nucleus, a pyridinium nucleus, a thiazolinium nucleus, a thiazolium nucleus, a naphthothiazolium nucleus, a selenazolium nucleus, a benzoselenazolium nucleus, an imidazolium nucleus, a tetrazolium nucleus, an indolenium nucleus, a pyrrolinium nucleus, an acridinium nucleus, a phenanthridinium nucleus, an isoquinolinium nucleus, an oxazolium nucleus, a naphthoxazolium nucleus, or a benzoxazolium nucleus. The substituent groups for $Z^{11}$ are, for example, an alkyl group, an alkenyl group, an aralkyl group, an aryl group, an alkenyl group, a hydroxy group, an alkoxy group, an aryloxy group, a halogen atom, an amino group, an alkylthio group, an arylthio group, an acyloxy group, an acylamino group, a sulfonyl group, a sulfonytoxy group, a sulfonylamino group, a carboxyl group, an acyl group, a carbamoyl group, a sulfamoyl group, a sulfo group, a cyano group, a ureido group, a urethane group, a carboxylic acid ester group, a hydrazine group, a hydrazone group or an imino group. At least one group can be selected from among the above mentioned substituent groups for the substituent group for $Z^{11}$, and in cases where there are two or more substituent groups these may be the same or different groups. Furthermore, the above mentioned substituent groups may be further substituted with these substituent groups. The total carbon member of $Z^{11}$ is up to 28.

Moreover, heterocyclic quaternary ammonium groups may be completed by $Z^{11}$ via an appropriate linking group as a substituent group of $Z^{11}$. In this case a so-called dimer structure is formed.

The quinolinium, benzoquinolinium benzimidazolium, pyridinium, acridinium, phenanthridinium and isoquinolinium nuclei are preferred as the heterocyclic ring completed by $Z^{11}$. Of these nuclei, the quinolinium and benzothiazolium nuclei are preferred, and the quinolinium nucleus is the most preferred.

The aliphatic groups of $R^{11}$ and $R^{12}$ are unsubstituted alkyl groups which have from 1 to 18 carbon atoms and substituted alkyl groups of which the alkyl part has from 1 to 18 carbon atoms. The substituent groups described as substituent groups for $Z^{11}$ can be used as substituent groups or the substituted alkyl groups of $R^{11}$ and $R^{12}$.

The aromatic groups represented by $R^{12}$ have from 6 to 20 carbon atoms, and they are, for example, phenyl groups or naphthyl groups. The groups described as substituent groups for $Z^{11}$ can be used as substituent groups for the aromatic groups represented by $R^{12}$. Aliphatic groups are preferred for $R^{12}$, and the methyl group and substituted methyl groups and bonding with the heterocyclic ring completed by Z to form a ring are most preferred.

At least one of the groups represented by $R^{11}$, $R^{12}$ and $Z^{11}$ is an alkenyl group, an acyl group, a hydrazine group or a hydrazino group, or $R^{11}$ and $R^{12}$ is combined to form a dihydropyridinium skeleton, but these may be substituted with the groups described earlier as substituent groups for the group represented by $Z^{11}$.

Those cases where at least one of the substituent groups on the groups or ring formed by $R^{11}$, $R^{12}$ and $Z^{11}$ is an alkynyl group or an acyl group and those cases where $R^{11}$ and $R^{12}$ are joined together to form a dihydropyridinium skeleton are preferred, and those cases where at least one alkynyl group is included are preferred, while the propargyl group is the most preferred.

Groups which can be represented by $X^1$-$(L^1)_m$- are preferred as the groups which promote adsorption on silver halide and which form substituent groups on $R^{11}$, $R^{12}$ and $Z^{11}$. Here, $X^1$ represents a group which promotes adsorption on silver halide, $L^1$ represents a divalent linking group and m represents 0 or 1.

The thioamido group, the mercapto group and five or six membered nitrogen containing heterocyclic groups can be cited as preferred examples of groups which promote adsorption on silver halide which can be represented by $X^1$.

These may be substituted with the groups described as substituent groups for $Z^{11}$. Non-cyclic thioamido groups (for example, thiourethane group or thioureido group) are preferred as thioamido groups.

Heterocyclic mercepto groups (for example, 5-mercaptotetrazole, 3-mercapto-1,2,4-triazole, 2-mercapto-1,3,4-thiadiazole, 2-mercapto-1,3,4-oxadiazole) are especially desirable as the mercapto groups of $X^1$.

The five or six membered nitrogen containing heterocyclic rings represented by $X^1$ are comprised of combinations of nitrogen, oxygen, sulfur and carbon, and those which form imino-silver, for example benzotriazole and aminothiatriazole, are preferred.

Atoms or groups of atoms including at least one atom selected from among C, N, S and O can be cited as divalent linking groups which can be represented by $L^1$. Actual examples include $C_{1-24}$ alkylene groups, $C_{2-24}$ alkenylene groups, $C_{2-24}$ alkynylene groups, $C_{6-24}$ arylene groups, —O—, —S—, —NH—, —N=, —CO—, —$SO_2$— (these groups may have substituent groups), either individually or in combinations.

Examples of combinations include $$-\overset{O}{\overset{\|}{C}}O-,\ -\overset{O}{\overset{\|}{C}}HN,\ SO_2NH-,\ -O\overset{O}{\overset{\|}{C}}NH-,\ -NH\overset{O}{\overset{\|}{C}}NH,$$

$$-NHSO_2NH-,\ -(\text{alkylene})-\overset{O}{\overset{\|}{C}}NH-,$$

$$-(\text{arylene})-SO_2NH-,\ -(\text{arylene})-NH\overset{O}{\overset{\|}{C}}NH-$$

and $$-(\text{arylene})-\overset{O}{\overset{\|}{C}}NH-.$$

The charge balancing counter ion $Y^{11}$ may be, for example, a bromine ion, a chlorine ion, an iodine ion, a p-toluenesulfonate ion, an ethylsulfonate ion, a perchlorate ion, a trifluoromethanesulfonate ion, a thiocyanate ion, a tetrafluoroboron ion or a hexafluorophosphorus ion.

These compounds and methods for their synthesis have been disclosed in the patents cited in *Research Disclosure* No. 22534 (published January 1983, pages 50 to 54), ibid, No. 23213 (published August 1983, pages 267 to 270), and in JP-B-49-38164, JP-B-52-19452, JP-B-52-47326, JP-A-52-69613, JP-A-52-3426, JP-A-55-138742, JP-A-60-11837, and U.S. Pat. Nos. 4,306,016 and 4,471,044.

Actual examples of compounds which can be represented by general formula (I) are indicated below, but these compounds are not limited to these examples.

(N-I-1) 5-Ethoxy-methyl-1-propargylquinolinium bromide (N-I-2) 2,4-Dimethyl-1-propargylquinolinium bromide (N-I-3) 2-Methyl-1-{3-[2-(4-methylphenyl)hydrazino]-butyl}-quinolinium iodide (N-I-4) 3,4-Dimethyl-dihydropyrido[2,1-b]-benzothiazolium bromide (N-I-5) 6-Ethoxythiocarbonylamino-2-methyl-1-propargylquinolinium trifluromethylsulfonate (N-I-6) 2-Methyl-6-(3-phenylthioureido)-1-propargylquinolinium bromide (N-I-7) 6-(5-Benzotriazolecarboxamido)-2-methyl-1-propargylquinolinium trifluoromethanesulfonate (N-I-8) 6-[3-(2-Mercaptoethyl)ureido]-2-methyl-1-propargylquinolinium trifluoromethanesulfonate (N-I-9) 6-{3-[3-(5-Mercapto-1,3,4-thiadiazol-2-ylthio)-propyl]ureido}-2-methyl-1-propargylquinolinium trifluoromethanesulfonate (N-I-10) 6-(5-Mercaptotetrazol-1-yl)-2-methyl-1-propargylquinolinium iodide (N-I-11) 1-Propargyl-2-(1-propenyl)quinolinium trifluoromethanesulfonate (N-I-12) 6-Ethoxythiocarbonylamino-2-(2-methyl-1-propenyl)-1-propargylquinolinium trifluoromethanesulfonate (N-I-13) 10-Propargyl-1,2,3,4-tetrahydroacridinium trifluoromethanesulfonate (N-I-14) 7-Ethoxythiocarbonylamino-10-propargyl-1,2,3,4-tetrahydroacridinium trifluoromethanesulfonate (N-I-15) 6-Ethoxythiocarbonylamino-1-propargyl-2,3-pentamethylenequinolinium trifluoromethanesulfonate (N-I-16) 7-[3-(5-Mercaptotetrazol-1-yl)benzamido]-10-propargyl-1,2,3,4-tetrahydoacridinium perchlorate (N-I-17) 6-[3-(5-Mercaptotetrazol-1-yl)benzamido]-1-propargyl-2,3-pentamethylenequinolinium bromide (N-I-18) 7-(5-mercaptotetrazol-1-yl)-9-methyl-10-propargyl-1,2,3,4-tetrahydroacridinium bromide (N-I-19) 7-[3-{N-[2-(5-mercapto-1,3,4-thiadiazol-2-ylthio)-ethyl]carbamoyl}propanamido]-10-propargyl-1,2,3,4-tetrahydroacridinium bromide (N-I-20) 6-(5-Mercaptotetrazol-1-yl)-4-methyl-1-propargyl-2,3-pentamethylenequinolinium bromide (N-I-21) 7-Ethoxythiocarbonylamino-10-propargyl-1,2-dihydroacridinium trifluoromethanesulfonate (N-I-22) 7-(5-Mercaptotetrazol-1-yl)-9-methyl-10-propargyl-1,2-dihydroacridinium hexafluoro phosphate (N-I-23) 7-[3-(5-mercaptotetrazol-1-yl)benzamido]-10-propargyl-1,2-dihydroacridinium bromide (N-I-24) 10-Propargyl-7-[3-(1,2,3,4-thiatriazol-5-ylamino)benzamido]-1,2,3,4-tetrahydroacridinium perchlorate (N-I-25) 7-(3-Cyclohexylmethoxythiocarbonylaminobenzamido)-10-propargyl-1,2,3,4-tetrahydroacridinium trifluoromethanesulfonate (N-I-26) 7-(3-Isopropoxythiocarbonylaminobenzamido)-10-propargyl-1,2,3,4-tetrahydroacridinium trifluoromethanesulfonate (N-I-27) 7-(3-methoxythiocarbonaylaminobenzamido)-10-propargyl-1,2,3,4-tetrahydroacridinium trifluoromethanesulfonate (N-I-28) 7-[3-(3-Ethoxythiocarbonylaminophenyl-)ureido]-10-propargyl-1,2,3,4-tetrahydroacridinium trifluoromethanesulfonate (N-I-29) 7- (3-Ethoxythiocarbonylaminobenzenesulfonamido)-10-propargyl-1,2,3,4-tetrahydro acridinium trifluoromethanesulfonate (N-I-30) 7-[3-{3-[3-(5-Mercaptotetrazol-1-yl) phenyl-]ureido}benzamido]-10-propargyl-1,2,3,4-tetrahydroacridinium trifluoromethanesulfonate (N-I-31) 7-[3-(5-Mercapto-1,3,4-thiadiazol-1-ylamino)-benzamido]-10-propargyl-1,2,3,4-tetrahydroacridinium trifluoromethanesulfonate (N-I-32) 7-[3-(3-Butylthioureido)benzamido]-10-propargyl-1,2,3,4-tetrahydroacridinium trifluoromethanesulfonate (N-I-33) 6-(3-Ethoxythiocarbonylaminobenzamido)-1-propargyl-2,3-trimethylenequinolinium trifluoromethanesulfonate.

When included in the photographic photosensitive material, the nucleating agents are preferably added to the internal latent image type silver halide emulsion layer, but as long as they diffuse during coating or during processing and become adsorbed on the silver halide, the nucleating agents may be added to other layers, for example to intermediate layers, under layers or backing layers. In those cases where the nucleating agent is added to a processing bath, it may be included in the development bath or in a low pH pre-bath as disclosed in JP-A-58-178350.

In those cases where the nucleating agent is included in the photographic photosensitive material the amount used is preferably from $10^{-8}$ to $10^{-2}$ mol, and most desirably from $10^{-7}$ to $10^{-3}$ mol, per mol of silver halide.

The conjoint use of nucleation accelerators is preferred in the present invention. Use can be made of the nucleation accelerators disclosed on pages 15 to 50 of JP-A-64-106656. Actual especially preferred examples are indicated below.

(A-1) 3-Mercapto-1,2,4-triazolo[4,5-a]pyridine (A-2) 3-Mercapto-1,2,4-triazolo[1,5-a]pyrimidine (A-3) 3-Mercapto-1,2,4-triazolo[4,5-a]pyrimidine (A-4) 7-(2-Dimethylaminoethyl)-5-mercapto-1,2,4-thiadiazolo[1,5-a]pyrimidine (A-5) 3-Mercapto-7-methyl-1,2,4-triazolo[4,5-a]pyrimidine (A-6) 3,6-Dimercapto-1,2,4-triazolo[4,5-b]pyridazine (A-7) 2-Mercapto-5-methylthio-1,3,4-thiadiazole (A-8) 3-Mercapto-4-methyl-1,2,4-triazole (A-9) 2-(3-Dimethylaminopropylthio)-5-mercapto-1,3,4-thiadiazole hydrochloride (A-10) 2-(2-Morpholinoethylthio)-5-mercapto-1,3,4-thiadiazole hydrochloride The presence of a backing layer which contains carbon or graphite (for example, carbon black, colloidal carbon, carbon graphite) is preferred in the present invention. Such a backing layer can be provided by finely dispersing colloidal carbon in a coating liquid which has been diluted with an organic solvent to provide the required coating density, using a colloidal carbon dispersion which is useful for preventing halation as disclosed, for example, in U.S. Pat. No. 2,271,234, and using alkali soluble substances such as the cellulose acetate phthalate disclosed in U.S. Pat. No. 2,327,828 as a carrier for the material which prevents the occurrence of halation, and then coating with this coating liquid.

Furthermore, the carbon or graphite can be used with a hydrophilic polymer, and especially polymers which are rendered soluble under high pH conditions, as a binder.

When carbon or graphite is used in such a backing layer there is an advantage in respect of the electrostatic properties and development processing suitability when compared, for example, to those cases in which a dye is used.

The anti-halation backing layers used in the present invention have a density with respect to white light when used under normal conditions preferably of from 0.1 to 2.0, and most preferably of from 0.5 to 1.5.

The photographic emulsions used in the present invention are spectrally sensitized with sensitizing dyes for photographic purposes in the usual way. Dyes from among the cyanine dyes, merocyanine dyes and complex merocyanine dyes are especially useful, and these dyes can be used individually or in combinations. Furthermore, super-sensitizing agents can be used conjointly with the above mentioned dyes. Actual examples have been detailed in the patents disclosed, for example, in *Research Disclosure* No. 17643-IV (published December 1978).

Anti-foggants or stabilizers can be included in the photographic emulsions which are used in the present invention with a view to preventing the occurrence of fogging during the manufacture, storage or photographic processing of the photosensitive material or with a view to stabilizing photographic performance. Actual examples have been disclosed in detail in *Research Disclosure* No. 17643-IV (published December 1978) and in *Stabilization of Photographic Silver Halide Emulsion*, by E. J. Birr (published by the Focal Press, 1974).

Various color couplers can be used in the direct positive photographic photosensitive materials of the present invention. Color couplers are compounds which undergo a coupling reaction with the oxidized form of a primary aromatic amine based color developing agent and form or release an essentially non-diffusible dye, and they are themselves preferably essentially non-diffusible compounds. Actual examples of useful color couplers include naphthol and phenol based compounds, pyrazolone and pyrazoloazole based compounds, and open chain and heterocyclic ketomethylene compounds. Actual examples of these cyan, magenta and yellow couplers which can be used in the present invention include the compounds disclosed in *Research Disclosure*, No. 17643 (published December 1978), page 25, section VII-D ibid, No. 81717 (published November 1979) and JP-A-62-215272 and in the patents cited in these documents.

Couplers of which the colored dyes have a suitable degree of diffusibility, non-color forming couplers, DIR couplers which release a development inhibitor as the coupling reaction proceeds and polymerized couplers can also be used.

The use of gelatin as the binding agent or protective colloid in the emulsion layers and intermediate layers of a photosensitive material of the present invention is convenient, but other hydrophilic colloids can also be used for this purpose.

Anti-color fogging agents and anti-color mixing agents can be used in photosensitive materials of the present invention. Typical examples of such agents have been disclosed on pages 600 to 663 of JP-A-62-215272.

Color reinforcing agents can be used in the present invention with a view to improving the color forming ability of the couplers. Typical examples of such compounds have been disclosed on pages 374 to 391 of JP-A-62-215272.

Dyes for preventing the occurrence of irradiation and halation, ultraviolet absorbers, plasticizers, fluorescent whiteners, matting agents, agents for preventing the occurrence of aerial fogging, coating promotors, film hardening agents, anti-static agents and agents for improving slip properties can be added to the photosensitive materials of the present invention. Typical examples of these additives have been disclosed in *Research Disclosure* No. 17643 VII to XIII (published December 1978), pages 25 to 27 and ibid, No. 18716 (published November 1979), pages 647 to 651.

The present invention can also be applied to multilayer multi-color photographic photosensitive materials which have at least two layers with different spectral sensitivities on a support. Multi-layer mult-color photographic materials usually have at least one red sensitive emulsion layer, at least one green sensitive emulsion layer and at least one blue sensitive emulsion layer on a support. The order in which these layers are arranged can be selected arbitrarily as required. The preferred order for the arrangement of the layers is, from the support side, red sensitive layer—green sensitive layer—blue sensitive layer, or, from the support side, green sensitive layer—red sensitive layer—blue sensitive layer. Furthermore, each of the aforementioned emulsion layers may be comprised of two or more emulsion layers which have different photographic speeds, and non-photosensitive (light-insensitive) layers may be present between two or more emulsion layers which have the same color sensitivity. Generally, a cyan forming coupler is included in the red sensitive emulsion layer, a magenta forming coupler is included in the green sensitive emulsion layer and a yellow forming coupler is included in the blue sensitive emulsion layer, but different combinations can be used, depending on the particular case.

The photosensitive materials of the present invention may have auxiliary layers, for example protective layers, intermediate layers, filter layers, anti-halation layers, backing layes and white reflecting layers, in addition to the silver halide emulsion layers.

The photographic emulsion layers and other layers in the photographic photosensitive materials of the present invention are coated onto a support as disclosed in *Research Disclosure* No. 17643, sections V VII (published December 1978), page 28, and in European Patent 0,102,253 and JP-A-61-97655. Furthermore, the methods of coating disclosed in *Research Disclosure* No. 17643, section XV, pages 28 to 29, can be used for this purpose.

The color photographic photosensitive materials in the present invention can be developed and processed using the normal methods disclosed in the aforementioned *Research Disclosure* No. 17643, pages 28 to 29, and from the left hand column to the right hand column on page 651 of *Research Disclosure* No. 18716.

The color development baths used for the development of photosensitive materials of the present invention are preferably aqueous alkaline solutions which contain a primary aromatic amine based color developing agent as the principal component. Amino-phenol based compounds can be used as color developing agents, but the use of p-phenylenediamine based compounds is preferred. Typical examples of these compounds include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline 3-methyl-4-amino-N-ethyl-N-$\beta$-methoxyethylaniline, and the sulfate, hydrochloride and p-toluenesulfonate salts of these compounds. Two or more of these compounds can be used conjointly, according to the intended purpose.

Moreover, pH buffers such as alkali metal carbonates, borates or phosphates, and development inhibitors or anti-foggants, such as bromide, iodide, benzimidazoles, benzothiazoles or mercapto compounds are generally included in the color development bath. Various preservatives such as hydroxylamine, diethylhydroxylamine, sulfite, hydrazines, phenylsemicarbazides, triethanolamine, catecholsulfonic acids and triethylenediamine(1,4-diazabicyclo[2,2,2]octane), organic solvents such as ethylene glycol and diethylene glycol, development accelerators such as benzyl alcohol, polyethylene glycol, quaternary ammonium salts and amines, dye forming couplers, competitive couplers, auxiliary developing agents such as 1-phenyl-3-pyrazolidone, thickeners, various chelating agents as typified by the aminopolycarboxylic acids, aminopolyphosphonic acids, alkylphosphonic acids and phosphonocarboxylic acids, for example ethylenediamine tetraacetic acid, nitrilotriacetic acid, diethylenetriamine penta-acetic acid, cyclohexanediamine tetra-acetic acid, hydroxyethylimino diacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid) and salts thereof, can be used, as required.

These color development baths are generally at a pH of from 9 to 12. Furthermore, the replenishment rate of these development baths depends on the color photographic photosensitive material which is being processed but, in general, it is not more than 3 ml per square meter of photosensitive material, and it can be set to less than 500 ml per square meter of photosensitive material by reducing the bromide ion concentration of the replenisher. It is desirable that evaporation and aerial oxidation of the bath should be prevented by minimizing the contact area with the air of the processing layer when the rate of replenishment has been reduced. The replenishment rate can be further reduced by using some means of preventing the accumulation of bromide ion in the development bath.

Bromine ion and traces of iodine ion accumulate in the color development bath as a result of the development of the silver halide grains. The iodine ion generally inhibits color development and is undesirable. The present invention can be used preferably since inhibition of development is unlikely to arise even in color development baths in which such iodine ions are present. The iodine ion in the color development bath is preferably present at a concentration of from 0.1 mg to 50 mg per liter.

The color development processing time is normally set between 1 and 5 minutes, but shorter processing times can be devised by raising the temperature, raising the pH or by increasing the concentration of the color developing agent.

The photographic emulsion layer is generally subjected to a bleaching process after color development. The bleaching process may be carried out at the same time as a fixing process (bleach-fix process) or it may be carried out separately. Moreover, a method of processing in which bleach-fixing is carried out after a bleaching process may be used to speed up processing. Furthermore, processing can be carried out with two connected bleach-fix baths, a fixing process can be carried out prior to a bleach-fix process, or a bleaching process may be carried out after a bleach-fix process, in accordance with the intended purpose of the processing. Compounds of poly-valent metals, such as iron(III), cobalt(III), chromium(VI) and copper(II), for example, and peracids, quinones and nitro compounds, for example, can be used as bleaching agents. Thus, ferricyanides; dichromates; organic complex salts of iron(III) or cobalt(III), for example, complex salts with aminopolycarboxylic acids such as ethylenediamine tetra-acetic acid, diethylenetriamine penta-acetic acid, cyclohexanediamine tetra-acetic acid, methylimino diacetic acid, 1,3-diaminopropane tetra-acetic acid and glycol ether diamine tetra-acetic acid, or citric acid, tartaric acid or malic acid, for example; persulfates; bromates; permanganates; and nitrobenzenes can be used as bleaching agents. The aminopolycarboxylic acid iron(III) complex salts are useful in bleach baths and in bleach-fix baths.

Persulfate is generally used as the bleaching agent in the color processing of cinematographic materials. This bleaching agent has a high bleaching capacity and is desirable from the viewpoints of more rapid processing and less environmental pollution, but it has a disadvantage in that bleach staining is liable to occur. Bleach staining is unlikely to occur with the combinations of color couplers and nucleating agents in accordance with the present invention and persulfate can be used. The persulfate which can be used is sodium persulfate or potassium persulfate, and this is preferably used at a concentration of from 10 grams to 100 grams per liter of bleaching solution.

Bleaching accelerators can be used, as required, in bleach baths, bleach-fix baths or bleach or bleach-fix pre-baths.

Thiosulfate, thiocyanate, thioether based compounds, thioureas and large amounts of iodide can be used, for example, as fixing agents, but thiosulfate is generally used, and ammonium thiosulfate in particular can be used in the widest range of applications. Sulfite, bisulfite, or carbonyl/bisulfite addition compounds are preferred as preservatives for bleach-fix pre-baths.

The silver halide color photographic photosensitive materials of the present invention are generally subjected to a water washing process and/or stabilization process after the de-silvering process. The amount of wash water used in a washing process can be fixed within a wide range, depending on the characteristics (for example, the materials such as couplers used therein) and application of the photosensitive material, the wash water temperature, the number of water washing tanks (the number of water washing stages), the replenishment system, i.e. whether a counter-flow or sequential (co-current) flow system is used, and various other factors. The relationship between the amount of water used and the number of washing tanks in a multistage counter-flow system can be obtained using the method outlined on pages 248 to 253 of the *Journal of the Society of Motion Picture and Television Engineers*, Vol. 64 (May 1955).

The pH of the washing-water in the processing of a photosensitive material of the present invention is from 4 to 9, and preferably from 5 to 8. The water washing temperature and-time can be set variously according to the characteristics and application of the photosensitive material, but in general, washing conditions of from 20 seconds to 10 minutes at a temperature of from 15° C. to 45° C., and preferably of from 30 seconds to 5 minutes at a temperature of from 25° C. to 40° C., are selected. Moreover, the photosensitive materials of this invention can be processed directly in a stabilizing bath instead of being subjected to a water wash as described above. The known methods disclosed in JP-A-57-8543, JP-A-58-14834 and JP-A-60-220345 can all be used for such stabilization processes.

Furthermore, in some cases a stabilization process is carried out following the aforementioned water washing process, and the use of a stabilizing bath which contains formalin and surfactant as used as a final bath for camera color photosensitive materials can be cited as an example of this type of process. Various chelating agents and fungicides can be added to these stabilizing baths.

The overflow which accompanies replenishment of the above mentioned water washing and/or stabilizing baths can be reused in other processes such as the de-silvering process for example.

Color developing agents can be incorporated into a silver halide color photosensitive material of the present invention with a view to simplifying and speeding up processing. The use of various color developing agent precursors is preferred for incorporation. For example, the indoaniline based compounds disclosed in U.S. Pat. No. 3,342,597, the Schiff's base type compounds disclosed in U.S. Pat. No. 3,342,599, *Research Disclosure*, No. 14850, and ibid, No. 15159, the aldol compounds disclosed in *Research Disclosure*, No. 13924, the metal complex salts disclosed in U.S. Pat. No. 3,719,492, and the urethane based compounds disclosed in JP-A-53-135628, can be used for this purpose.

Various 1-phenyl-3-pyrazolidones can be incorporated, as required, into the silver halide color photosensitive materials of the present invention with a view to accelerating color development. Typical compounds have been disclosed, for example, in JP-A-56-64339, JP-A-57-144547 and JP-A-58-115438.

The various processing baths in this invention are used at a temperature of from 10° C. to 50° C. The standard temperature is generally from 33° C. to 38° C., but accelerated processing and shorter processing times can be realized at higher temperatures while increased picture quality and improved processing bath stability can be achieved at lower temperatures.

The present invention is hereinafter described in greater detail with reference to examples, which are not to be construed as limiting the scope thereof.

EXAMPLE 1

Sample 101, a multi-layer color photosensitive material, was prepared by the lamination coating of the layers of which the compositions are indicated below onto an under-coated cellulose triacetate film. The emulsions in each layer were prepared on the basis of the method for the preparation of the emulsion EM-1 described hereinafter.

| | |
|---|---|
| First Layer: Gelatin Layer | |
| A gelatin layer containing: | |
| Ultraviolet absorber Cpd-1 | 0.04 g/m$^2$ |
| Ultraviolet absorber Cpd-2 | 0.18 g/m$^2$ |
| Cpd-4 | 0.09 g/m$^2$ |
| Second Layer: Intermediate Layer | |
| A gelatin layer containing: | |
| Compound Cpd-7 | 0.30 g/m$^2$ |
| Coupler IIb-4 | 0.07 g/m$^2$ |
| Cpd-3 | 0.11 g/m$^2$ |
| Cpd-5 | 0.01 g/m$^2$ |
| Third Layer: First Red Sensitive Emulsion Layer | |
| A gelatin layer containing: | |
| Silver bromide (average grain size 0.25μ, size distribution (variation coefficient) 8%, octahedral) | 0.58 g/m$^2$ |
| Sensitizing dye I | 7.0 × 10$^{-5}$ mol/mol · Ag |
| Sensitizing dye II | 2.0 × 10$^{-5}$ mol/mol · Ag |
| Sensitizing dye III | 2.8 × 10$^{-4}$ mol/mol · Ag |
| Sensitizing dye IV | 2.0 × 10$^{-5}$ mol/mol · Ag |
| Coupler C-3 | 0.26 g/m$^2$ |
| Coupler C-4 | 0.01 g/m$^2$ |
| Coupler IIa-6 | 0.01 g/m$^2$ |
| Fourth Layer: Second Red Sensitive Emulsion Layer | |
| A gelatin layer containing: | |
| Silver bromide (average grain size 0.40μ, size distribution 10%, octahedral) | 1.3 g/m$^2$ |
| Sensitizing dye I | 5.2 × 10$^{-5}$ mol/mol · Ag |
| Sensitizing dye II | 1.5 × 10$^{-5}$ mol/mol · Ag |
| Sensitizing dye III | 2.1 × 10$^{-4}$ mol/mol · Ag |
| Sensitizing dye IV | 1.5 × 10$^{-5}$ mol/mol · Ag |
| Coupler C-12 | 0.06 g/m$^2$ |
| Coupler C-3 | 0.04 g/m$^2$ |
| Coupler C-13 | 0.01 g/m$^2$ |
| Coupler IIa-6 | 0.03 g/m$^2$ |
| Cpd-3 | 0.12 g/m$^2$ |
| Cpd-4 | 0.11 g/m$^2$ |
| Fifth Layer: Third Red Sensitive Emulsion Layer | |
| A gelatin layer containing: | |

-continued

| | |
|---|---|
| Silver bromide (average grain size 0.60μ, size distribution 15%, octahedral) | 0.9 g/m$^2$ |
| Sensitizing dye I | 5.5 × 10$^{-5}$ mol/mol · Ag |
| Sensitizing dye II | 1.6 × 10$^{-5}$ mol/mol · Ag |
| Sensitizing dye III | 2.2 × 10$^{-5}$ mol/mol · Ag |
| Sensitizing dye IV | 1.6 × 10$^{-5}$ mol/mol · Ag |
| Coupler C-12 | 0.04 g/m$^2$ |
| Coupler C-3 | 0.03 g/m$^2$ |
| Cpd-3 | 0.06 g/m$^2$ |
| Cpd-4 | 0.05 g/m$^2$ |
| Sixth Layer: Intermediate Layer | |
| A gelatin layer containing: | |
| Compound Cpd-7 | 0.02 g/m$^2$ |
| Seventh Layer: First Green Sensitive Emulsion Layer | |
| A gelatin layer containing: | |
| Silver bromide (average grain size 0.25μ, size distribution 8%, octahedral) | 1.54 g/m$^2$ |
| Sensitizing dye V | 3.8 × 10$^{-4}$ mol/mol · Ag |
| Sensitizing dye VI | 3.0 × 10$^{-5}$ mol/mol · Ag |
| Coupler C-6 | 0.29 g/m$^2$ |
| Coupler IIb-4 | 0.05 g/m$^2$ |
| Coupler IIb-9 | 0.08 g/m$^2$ |
| Coupler C-4 | 0.06 g/m$^2$ |
| Cpd-3 | 0.31 g/m$^2$ |
| Eighth Layer: Second Green Sensitive Emulsion Layer | |
| A gelatin layer containing: | |
| Silver bromide (average grain size 0.40μ, size distribution 10%, octahedral) | 0.61 g/m$^2$ |
| Sensitizing dye V | 2.7 × 10$^{-4}$ mol/mol · Ag |
| Sensitizing dye VI | 2.1 × 10$^{-5}$ mol/mol · Ag |
| Coupler C-6 | 0.03 g/m$^2$ |
| Coupler C-9 | 0.001 g/m$^2$ |
| Coupler IIb-9 | 0.001 g/m$^2$ |
| Cpd-3 | 0.034 g/m$^2$ |
| Ninth Layer: Third Green Sensitive Emulsion Layer | |
| A gelatin layer containing: | |
| Silver bromide (average grain size 0.65μ, size distribution 16%, octahedral) | 0.7 g/m$^2$ |
| Sensitizing dye V | 3.0 × 10$^{-4}$ mol/mol · Ag |
| Sensitizing dye VI | 2.4 × 10$^{-5}$ mol/mol · Ag |
| Coupler C-6 | 0.03 g/m$^2$ |
| Coupler IIb-9 | 0.001 g/m$^2$ |
| Cpd-3 | 0.04 g/m$^2$ |
| Tenth Layer: Intermediate Layer | |
| (Same as the sixth layer) | |
| Eleventh Layer: Yellow Filter Layer | |
| A gelatin layer containing: | |
| Yellow colloidal silver | 0.036 g/m$^2$ |
| Compound H-1 (1,2-bis(vinylsulfonylacetoamido)ethane) | 0.10 g/m$^2$ |
| Coupler IIb-4 | 0.08 g/m$^2$ |
| Cpd-3 | 0.09 g/m$^2$ |
| Twelfth Layer: Intermediate Layer | |
| (Same as the sixth layer) | |
| Thirteenth Layer: First Blue Sensitive Emulsion Layer | |
| A gelatin layer containing: | |
| Silver bromide (average grain size 0.40μ, size distribution 8%, octahedral) | 0.34 g/m$^2$ |
| Coupler C-10 | 0.41 g/m$^2$ |
| Coupler C-14 | 0.27 g/m$^2$ |
| Cpd-3 | 0.16 g/m$^2$ |

-continued

| | |
|---|---|
| Fourteenth Layer: Second Blue Sensitive Emulsion Layer | |
| A gelatin layer containing: | |
| Silver chlorobromide (8 mol % silver chloride, average grain size 0.60μ, size distrbution 11%, tetradecahedral) | 0.49 g/m$^2$ |
| Coupler C-10 | 0.15 g/m$^2$ |
| Cpd-3 | 0.06 g/m$^2$ |
| Fifteenth Layer: Third Blue Sensitive Emulsion Layer | |
| A gelatin layer containing: | |
| Silver bromide (average grain size 0.85μ, size distribution 18%, octahedral) | 0.75 g/m$^2$ |
| Sensitizing dye VII | $2.3 \times 10^{-4}$ mol/mol · Ag |
| Coupler C-10 | 0.05 g/m$^2$ |
| Cpd-3 | 0.02 g/m$^2$ |
| Sixteenth Layer: First Protective Layer | |
| A gelatin layer containing: | |
| Ultraviolet absorber Cpd-1 | 0.05 g/m$^2$ |
| Ultraviolet absorber Cpd-2 | 0.24 g/m$^2$ |
| Cpd-4 | 0.12 g/m$^2$ |
| Seventeenth Layer: Second Protective Layer | |
| A gelatin layer containing: | |
| Poly(methyl methacrylate) particles (diameter 1.5μ) | 0.05 g/m$^2$ |

A backing layer (eighteenth layer) as indicated below was coated onto the reverse side of the support.

| Eighteenth Layer: Backing Layer | |
|---|---|
| Methyl methacrylate/methacrylic acid copolymer (copolymer mol ratio 1:1) | 1.5 parts |
| Cellulose acetate hexahydrophthalate (Hydroxypropyl group 4%, methyl group 15%, acetyl group 8%, phthalyl group 36%) | 1.5 parts |
| Acetone | 50 parts |
| Methanol | 25 parts |
| Methyl cellosolve | 25 parts |
| Colloidal carbon | 1.2 parts |

A coating liquid was prepared in the proportions indicated above and this was coated in such a way as to provide a density with respect to white light of 1.0.

The gelatin hardening agent C-11 was added to each layer in addition to the components indicated above.

The compounds used in the preparation of this sample are indicated below.

Cpd-1

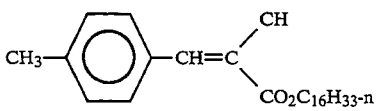

Cpd-2

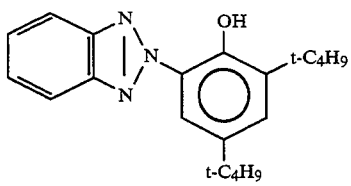

Tricresyl phosphate — Cpd-3

Dibutyl phthalate — Cpd-4

Bis(2-ethylhexyl)phthalate — Cpd-5

Cpd-6

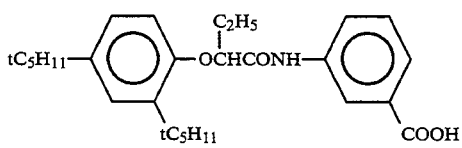

Cpd-7

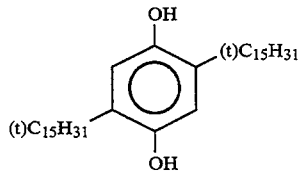

C-3

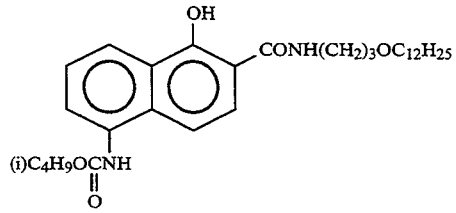

-continued
C-4
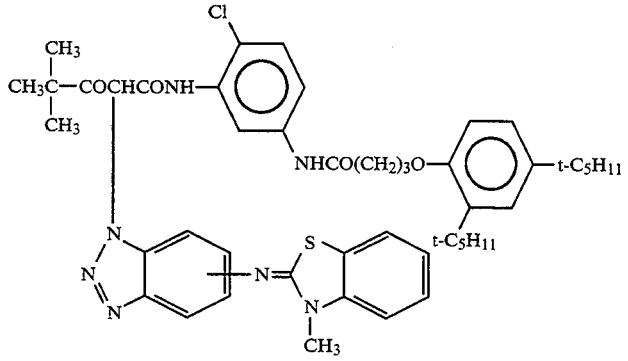
C-6
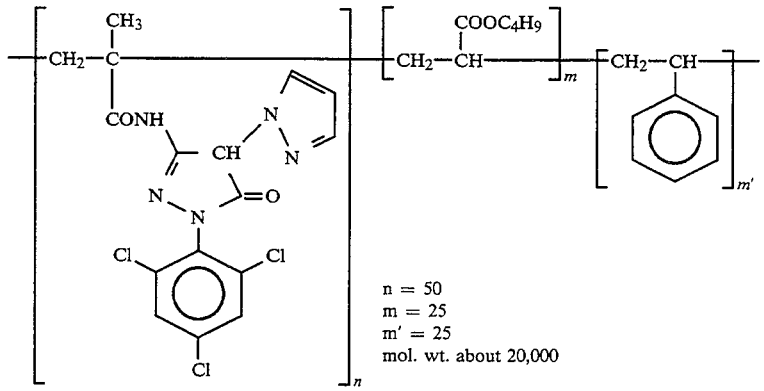
n = 50
m = 25
m' = 25
mol. wt. about 20,000
C-9
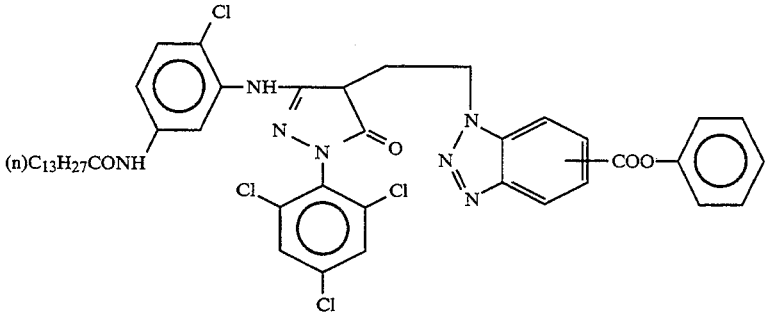
C-10
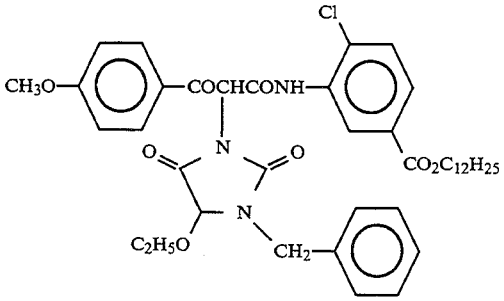
$(CH_2{=}CHSO_2CH_2CONHCH_2)_2$ c-11
C-12
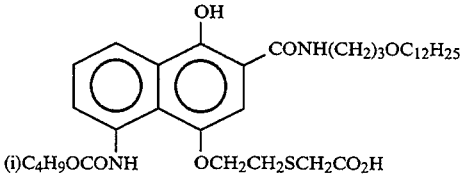

-continued
C-13
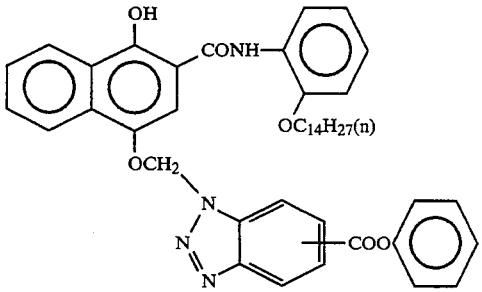
C-14
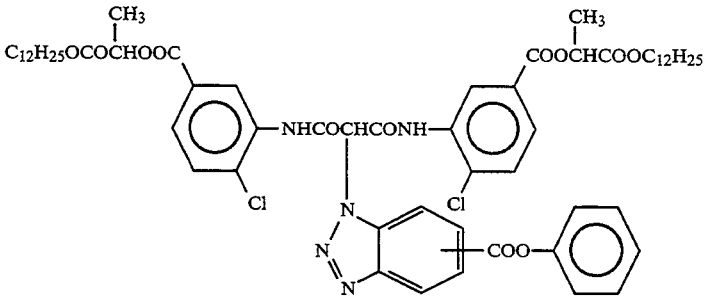
Sensitizing dye I
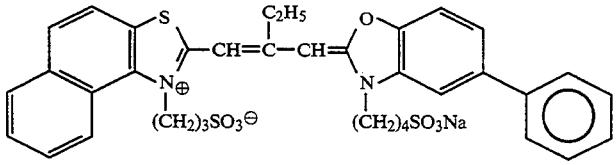
Sensitizing dye II
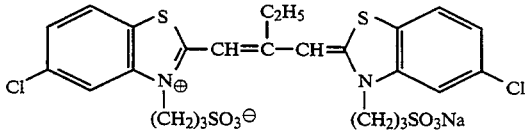
Sensitizing dye III
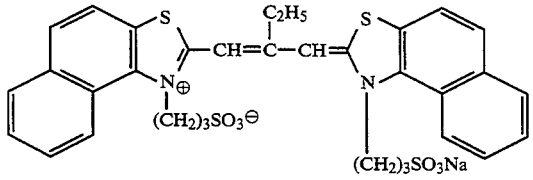
Sensitizing dye IV
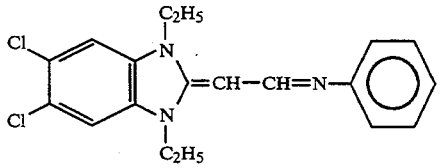
Sensitizing dye V
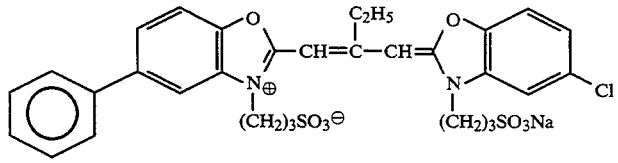
Sensitizing dye VI
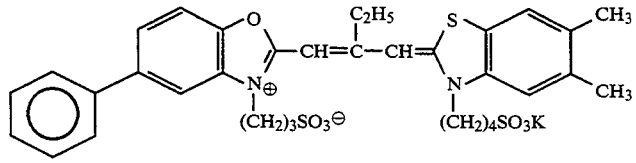

-continued

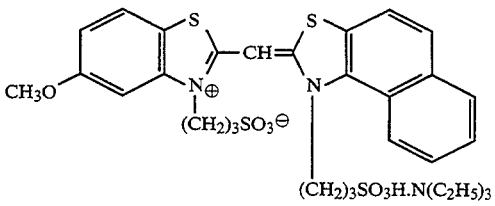

Sensitizing dye VII

Preparation of Emulsion EM-1

Aqueous solutions of potassium bromide and silver nitrate were added simultaneously with vigorous agitation over a period of 15 minutes at 75° C. to an aqueous gelatin solution and octahedral silver bromide grains of average grain size 0.35μ were obtained. At this time, 0.3 gram per mol of silver of 3,4-dimethyl-1,3-thiazolin-2-thione was added. Next, 6 mg of sodium thiosulfate and 7 mg of chloroauric acid (tetra-hydrate) per mol of silver were added sequentially to the emulsion and a chemical sensitization treatment was carried out by heating to 75° C. for 80 minutes. The grains obtained in this way were then used as core grains on which a shelf was grown under the same precipitation conditions used to form the core and ultimately an octahedral mono-disperse core/shell silver bromide emulsion of average grain size 0.7μ was obtained. The variation coefficient of the grain size was about 10%. Sodium thiosulfate (1.5 mg) and 1.5 mg of chloroauric acid (tetra-hydrate) per mol of silver were added to the emulsion, chemical sensitization was carried out by heating to 60° C. for 60 minutes and an internal latent image type silver halide emulsion was obtained.

ExZK-1 and ExZK-2 were used at rates of $10^{-3}$ wt % and $10^{-2}$ wt % respectively as a nucleating agent and Cpd-8 was used at a rate of $10^{-2}$ wt % as a nucleation accelerator in each photosensitive layer. Moreover "Alkanol XC" (Dupont Co.) and sodium alkylbenzenesulfonate were used in each layer as emulsification and dispersing agents, and succinate ester and Magefac F-120 (Dainippon Ink Co.) were used in each layer as coating promotors. Cpd-9, 10, 11 was used as a stabilizer in the silver halide and colloidal silver containing layers. The sample so obtained was Sample 101. The compounds used in this example are indicated below.

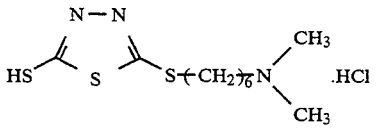

Cpd-8

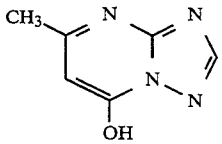

Cpd-9

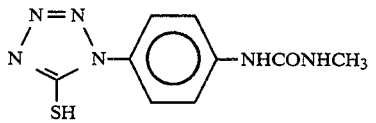

Cpd-10

-continued

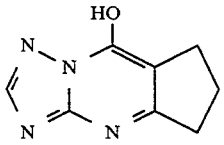

Cpd-11

ExZK-1 7-(3-Ethoxythiocarbonylaminobenzamido)-9-methyl-10-propargyl-1,2,3,4-tetrahydroacridinium trifluoromethanesulfonate ExZK-2 2-[4-{3-[3-{3-[5-{3-[2-chloro-5-(1-dodecyloxycarbonylethoxycarbonyl)phenylcarbamoyl]-4-hydroxy-1-naphthylthio}tetrazol-1-yl]phenyl-}ureido]-benzenesulfonamido}phenyl]-1-formylhydrazine Samples 102 to 114 were prepared by altering the colored couplers IIa-6, IIb-4 and IIb-9 of Sample 101, and the nucleating agent and nucleation accelerator, in the way indicated in Table 1.

These samples were subjected to a sensitometric exposure and color development processing.

The processed samples were subjected to density measurements with red, green and blue filters,

| Processing Operation | Temperature (°C.) | Time |
|---|---|---|
| 1. Pre-bath | 27 ± 1 | 10 seconds |
| 2. Backing removal and spray wash | 27 – 38 | 5 seconds |
| 3. Color Development | 41.1 ± 0.1 | 3 minutes |
| 4. Stop | 27 – 38 | 30 seconds |
| 5. Bleach promotion | 27 ± 1 | 30 seconds |
| 6. Bleach | 38 ± 1 | 3 minutes |
| 7. Water wash | 27 – 38 | 1 minute |
| 8. Fix | 38 ± 1 | 2 minutes |
| 9. Water wash | 27 – 38 | 2 minutes |
| 10. Stabilization | 27 – 38 | 10 seconds |

The formulation of the processing bath used in each processing operation was as indicated below,

| Formulation of the Processing Baths | Amount Formulated |
|---|---|
| (1) Pre-bath | |
| Water at 27° C. to 38° C. | 800 ml |
| Borax (deca-hydrate) | 20.0 grams |
| Sodium sulfate (anhydrous) | 100 grams |
| Sodium hydroxide | 1.0 gram |
| Water to make up to | 1.00 liter |
| pH (27° C.) | 9.25 |
| 3. Color Developer | |
| Water at 21° C. to 38° C. | 850 ml |
| Kodak Anti-calcium No. 4 | 2.0 ml |
| Sodium sulfate (anhydrous) | 2.0 grams |
| Eastman Anti-fog No. 9 | 0.22 gram |
| Sodium bromide (anhydrous) | 1.20 grams |
| Sodium carbonate (anhydrous) | 25.6 grams |
| Sodium bicarbonate | 2.7 grams |
| Color developing agent: 4 (N-ethyl-N-(β-methanesulfonamidoethyl)-N-toluidine | 4.0 grams |

-continued

| Formulation of the Processing Baths | Amount Formulated |
|---|---|
| Water to make up to | 1.00 liter |
| pH (27° C.) | 10.20 |
| 4. Stop | |
| Water at 21° C. to 38° C. | 900 ml |
| 7.0N Sulfuric acid | 50 ml |
| Water to make up to | 1.00 liter |
| pH (27° C.) | 0.9 |
| 5. Bleach Promotor | |
| Water | 900 ml |
| Sodium metabisulfite (anhydrous) | 10.0 grams |
| Glacial acetic acid | 25.0 ml |
| Sodium acetate | 10.0 grams |
| EDTA-4Na | 0.7 gram |
| PBA | 5.5 grams |
| Water to make up to | 1.0 liter |
| pH (27° C.) | 3.8 ± 0.2 |
| PBA indicates 2-Dimethylaminoethylisothiourea dihydrochloride | |
| 6. Bleach Bath | |
| Water at 24° C. to 38° C. | 800 ml |
| Gelatin | 0.5 gram |
| Sodium persulfate | 33.0 grams |
| Sodium chloride | 15.0 grams |
| Mono-sodium phosphate (anhydrous) | 9.0 grams |
| Phosphoric acid (85%) | 2.5 ml |
| Water to make up to | 1.0 liter |
| pH (27° C.) | 2.3 ± 0.2 |
| 8. Fixer | |
| Water at 20° C. to 38° C. | 700 ml |
| Kodak Anti-calcium No. 4 | 2.0 ml |
| 58% Ammonium thiosulfate solution | 185 ml |
| Sodium sulfite (anhydrous) | 10.0 grams |
| Sodium bisulfite (anhydrous) | 8.4 grams |
| Water to make up to | 1.0 liter |
| pH (27° C.) | 6.5 |
| 10. Stabilizer | |
| Water at 21° C. to 27° C. | 1.00 liter |
| Kodak Stabilizer Additive | 0.14 ml |
| Formalin (37.5% solution) | 1.50 ml |

The comparative compounds in Table 1 are indicated below:

ExZK-3

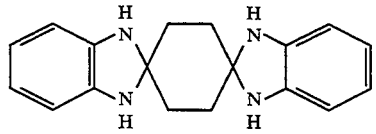

(U.S. Pat. No. 3,850,638)

ExZK-4

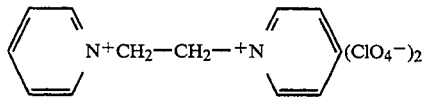

(U.S. Pat. No. 3,330,655)

ExZK-5

1-Formyl-2-{4-[3-(2-methoxyhoxyhenyl)ureido]-phenyl}-hydrazine

Cpd-12

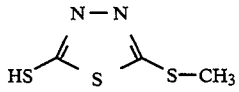

In Table 1, the fresh storage properties are indicated by the extent of the change of the 1.5 density measured with a G filter when the coated sample had been stood for 15 days under conditions of 40° C. and 70% relative humidity (RH). Values close to zero represent the best results. Furthermore, the latent image storage properties are indicated by the extent of the change in density when an exposed sample had stood for 60 minutes, and again values close to zero represent the best results. The print timing relates to the making of dupe negatives from a master negative using Samples 101 to 114, and when the change in the exposure conditions (timing) for printing on the positive film from the master negative and from the dupe negative was not greatly changed the

TABLE 1

| Sample No. | | Colored coupler Layer 3, 4 | 7, 8, 9 | 2, 7, 11 | Nucleating agent | Nucleation accelerator | Photographic properties (G) Dmin | Dmax | Fresh storage properties $\Delta D_{1.5}$ (G) 40-70%-15 days | Latent image storage properties $\Delta D_{1.5}$ (G) 25-60%-60 minutes | Print timing |
|---|---|---|---|---|---|---|---|---|---|---|---|
| 101 | This Invention | IIa-6 | IIb-9 | IIb-4 | ExZK-1, 2 | Cpd-8 | 0.44 | 2.78 | −0.03 | +0.02 | ○ |
| 102 | Comparative Example | — | — | — | " | " | 0.06 | 2.39 | −0.03 | +0.04 | X |
| 103 | This Invention | IIa-6 | IIb-9 | IIb-4 | " | — | 0.47 | 2.66 | −0.05 | +0.02 | ○ |
| 104 | Comparative Example | — | — | — | " | — | 0.08 | 2.31 | −0.04 | +0.05 | X |
| 105 | Comparative Example | IIa-6 | IIb-9 | IIb-4 | (Fogged) | Cpd-8 | 0.51 | 2.48 | −0.12 | +0.08 | ○ |
| 106 | Comparative Example | — | — | — | " | " | 0.12 | 2.16 | −0.04 | +0.10 | X |
| 107 | Comparative Example | IIa-6 | IIb-9 | IIb-4 | " | — | 0.54 | 2.33 | −0.15 | +0.11 | ○ |
| 108 | Comparative Example | — | — | — | " | — | 0.15 | 2.01 | −0.03 | +0.13 | X |
| 109 | This Invention | IIa-6 | IIb-9 | IIb-4 | ExZK-1 | Cpd-8 | 0.44 | 2.65 | −0.06 | +0.03 | ○ |
| 110 | This Invention | " | " | " | " | — | 0.47 | 2.31 | −0.07 | +0.04 | ○ |
| 111 | Comparative Example | " | " | " | ExZK-3 | Cpd-8 | 0.48 | 1.93 | −0.18 | +0.04 | ○ |
| 112 | Comparative Example | " | " | " | ExZK-4 | " | 0.50 | 1.72 | −0.14 | +0.05 | ○ |
| 113 | Comparative Example | " | " | " | ExZK-5 | " | 0.46 | 2.19 | −0.07 | +0.03 | ○ |
| 114 | This Invention | " | " | " | ExZK-1, 2 | Cpd-12 | 0.44 | 2.31 | −0.05 | +0.03 | ○ |

result is indicated as O, and when there was a change the result is indicated as X. A "O" result is essential for the dupe negative.

It is clear from Table 1 that the samples of the present invention had a high $D_{max}$, a low $D_{min}$ and good fresh storage properties and latent image storage properties, and they had good characteristics as materials for the preparation of dupe negatives. Furthermore, there was no undesirable staining by the persulfate bleach.

EXAMPLE 2

Running equilibrium baths (process B) were prepared by processing 140 m per day of negative film A for cinematographic purposes (type 8511) for 1 month in the development process (process A) indicated in Example 1 while replenishing the baths in the usual way. On analyzing the color development bath it was found to contain 8 mg/liter of iodine ion. Samples 101, 103, 105, 107 and 109 to 114 indicated in Example 1 were each processed in process A and process B and the results obtained are shown in Table 2.

TABLE 2

| Expt. No. | Sample No. | $\gamma(D_{2.0}-D_{1.0})$ (G) Process A | Process B |
|---|---|---|---|
| 201 | 101 | 1.02 | 1.02 |
| 202 | 103 | 1.01 | 0.98 |
| 203 | 105 | 1.01 | 0.90 |
| 204 | 107 | 0.99 | 0.85 |
| 205 | 109 | 1.02 | 1.02 |
| 206 | 110 | 1.00 | 0.98 |
| 207 | 111 | 0.98 | 0.82 |
| 208 | 112 | 0.96 | 0.76 |
| 209 | 113 | 0.98 | 0.86 |
| 210 | 114 | 1.00 | 0.98 |

In Table 2, $\gamma(D_{2.0}-D_{1.0})$ indicates the absolute value of the slope ($\gamma$) between D=1.0 and D=2.0 on the sensitometric curve measured with a G filter. This value preferably has a value close to 1.00, and it is preferably unchanged in process B where iodine has been introduced. The samples of the present invention exhibited good characteristics, but in those cases where a nucleating agent was used in particular, the iodine ion dependence was suitably small when a specified nucleation accelerator had been used.

EXAMPLE 3

Sample 115 was prepared in the same way as Sample 101 except that the first gelatin layer in Sample 101 in Example 1 was changed to an anti-halation layer which contained black colloidal silver and the colloidal carbon was omitted from the eighteenth layer, the backing layer.

| First Layer: Anti-halation Layer<br>A gelatin layer containing: | |
|---|---|
| Black colloidal silver | 0.18 g/m$^2$ |
| Ultraviolet absorber Cpd-1 | 0.04 g/m$^2$ |
| Ultraviolet absorber Cpd-2 | 0.18 g/m$^2$ |
| Cpd-4 | 0.09 g/m$^2$ |

The sharpness and bleaching time were measured for Samples 101 and 115.

Sharpness was evaluated by measuring the MTF of the green sensitive layer and the red sensitive layer.

MTF values were measured using the method described on page 605 of *The Theory of the Photographic Process,* 4th edition (Macmillan). Exposure was made using white light and, after processing, the magenta density was measured using a green filter and the cyan density was measured using a red filter. There was no great difference in sharpness.

The bleaching time was measured by varying the bleaching time and measuring the amount of silver remaining when the bleaching reaction had been completed. With Sample 101 the bleaching time was 70 seconds and with Sample 115 the bleaching time was 100 seconds. In terms of bleaching performance the samples with which a resin backing had been used were preferred.

EXAMPLE 4

A resolution chart was contact printed onto Sample 101 of Example 1 and a dupe negative of the resolution chart was prepared by carrying out development processing as described in Example 1. On the other hand, the resolution chart was contact printed using commercial Fujicolor intermediate 8213 material (made by Fuji Photo Film Co., Ltd.) and a positive image was obtained by development processing in the way described in Example 1. This positive image was contact printed again onto the intermediate film to provide a dupe negative of the resolution chart. On measuring the resolution of both dupe negatives it was found to be 100 lines/mm with Sample 101 and 70 lines/mm with the intermediate film. Thus, it is possible to prepare dupe negatives which have better resolution than that of the conventional system if a photosensitive material of the present invention is used.

EXAMPLE 5

Sample 501 was prepared in the same manner as Sample 101 in Example 1 except that the colored coupler IIa-6 in the 3rd and 4th layers was replaced by C-15 described below, and the colored coupler IIb-9 in the 7th, 8th and 9th layers and the colored coupler IIb-4 in the 2nd, 7th and 11th layers were replaced by C-16 described below in the equimolar amount, respectively. Sample 501 was subjected to the same tests as those of Example 1.

The results are shown in Table 3.

TABLE 3

| Sample No. | Photographic Properties (G) Dmin | Dmax | Fresh storage properties $\Delta D_{1.5}$(G) 40-70%-15 days | Latent image storage properties $\Delta D_{1.5}$(G) 25-60%-60 minutes | Print timing |
|---|---|---|---|---|---|
| 501 | 0.43 | 2.89 | −0.12 | +0.05 | Δ |
| 101 | 0.44 | 2.78 | −0.03 | +0.02 | ○ |

C-15

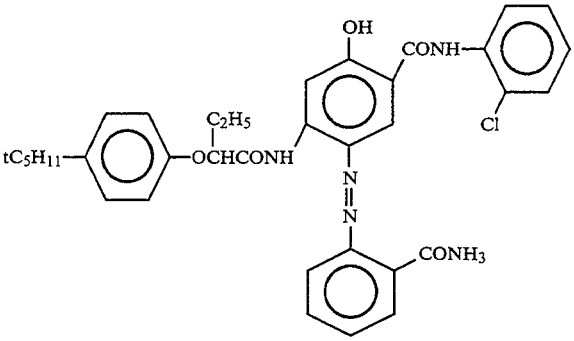

C-16

TABLE 3-continued

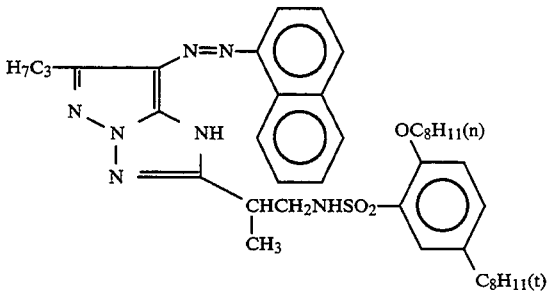

It is apparent from Table 3 that Sample 501 containing the comparative colored couplers is inferior to Sample 101 in fresh storage properties and latent image storage properties, and as a material for a dupe negative.

EXAMPLE 6

Sample 601 to 608 were prepared in the same manner as Sample 101 in Example 1 except that the colored coupler and the nucleating agent were changed as indicated in Table 4 below. Samples 601 to 608 were subjected to the same tests as those of Example 1.

The results are shown in Table 4.

TABLE 4

| Sample No. | Colored coupler ($g/m^2$) Layer 2 | 3 | 4 | 7* | 8 | 9 | 11 | Nucleating Agent (wt %) ExZL-1 | ExZK-2 |
|---|---|---|---|---|---|---|---|---|---|
| 601 (Comparison) | 0.01 | — | 0.01 | 0.01 | — | — | 0.01 | $10^{-3}$ | $10^{-3}$ |
| 602** (Invention) | 0.07 | 0.01 | 0.03 | 0.13 | 0.001 | 0.001 | 0.08 | " | " |
| 603 (Comparison) | 0.20 | 0.20 | 0.20 | 0.40 | — | — | 0.20 | " | " |
| 604 (Comparison) | 0.07 | 0.01 | 0.02 | 0.13 | 0.001 | 0.001 | 0.08 | " | $10^{-1}$ |
| 605 (Comparison) | " | " | " | " | " | " | " | " | $10^{-3}$ |
| 606 (Comparison) | " | " | " | " | " | " | " | $5 \times 10^{-4}$ | $10^{-2}$ |
| 607 (Comparison) | " | " | " | " | " | " | " | $10^{-8}$ | — |

| Sample No. | Photographic properties Dmin | Dmax | Sensitivity | Fresh storage properties $\Delta D_{1.5}$ (G) 40°-70%-15 days | Latent image storage properties $\Delta D_{1.5}$ (G) 25°-60%-60 min. | Print timing |
|---|---|---|---|---|---|---|
| 601 (Comparison) | 0.18 | 2.53 | 100 | −0.03 | +0.04 | X |
| 602** (Invention) | 0.44 | 2.78 | 100*** | −0.03 | +0.02 | ○ |
| 603 (Comparison) | 1.01 | 2.98 | 38 | −0.06 | +0.05 | X |
| 604 (Comparison) | 2.36 | 3.05 | 3 | +0.18 | −0.32 | X |
| 605 (Comparison) | 0.42 | 2.49 | 108 | −0.03 | +0.00 | ○ |
| 606 (Comparison) | 0.41 | 2.46 | 110 | −0.03 | +0.01 | ○ |
| 607 (Comparison) | 0.43 | 0.51 | — | — | — | X |

*total amount
**same as Sample 101
***Sensitivity is a relative value (exposure amount ratio to obtain a density of Dmin + 0.2) taking the sensitivity of Sample 602 as 100.

It is apparent from Table 4 that there is a suitable amount range with respect to a colored coupler and a nucleating agent which can be used for a direct positive negative dupe material.

EXAMPLE 7

Sample 701 was prepared in the same manner as Sample 101 in Example 1 except that the silver halide in the 7th and 8th layers was replaced by a silver halide whose appearance of crystals is not definite (potato like shape), having the same average grain size and having the size distribution of 20%. Sample 701 was subjected to the same tests as those of Example 1. As a result, it turned out that Sample 701 showed low Dmax and high Dmin, and unsatisfactry fresh storage properties.

EXAMPLE 8

Processes C to H were prepared in the same manner as Processes A and B except that 0 mg, 2 mg, 8 mg, 20 mg, 50 mg, or 100 mg of iodine ion as a potassium salt was added to 1 liter of color developer, respectively. The substantially same results were obtained when the same tests were conducted. But in a case of Processes C and H, the effect of the invention was small.

While the invention has been described in detail and with reference to specific embodiments thereof, it will be apparent to one skilled in the art that various changes and modifications can be made therein without departing from the spirit and scope thereof.

What is claimed is:

1. A silver halide color photographic direct positive photo-sensitive material comprising a transparent support on which there is provided at least one cyan color forming coupler containing layer, at least one magenta color forming coupler containing layer, at lease one yellow color forming coupler containing layer, and at least one light-sensitive layer, wherein a compound represented by formula (I), a colored coupler represented by formula (IIa) or (IIb) or both, and an internal image forming silver halide grain are contained in the photographic material:

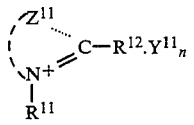

(I)

wherein $Z^{11}$ represents a group of non-metal atoms which is required to form a five or six membered heterocyclic ring, and $Z^{11}$ may be substituted with substituent groups; $R^{11}$ is an aliphatic group; and $R^{12}$ is a hydrogen atom, an aliphatic group or an aromatic group; $R^{11}$ and $R^{12}$ may be substituted with substituent groups; $R^{12}$ may be joined to the heterocyclic ring completed by $Z^{11}$ to form a ring; provided that at least one of the groups $R^{11}$, $R^{12}$ and $Z^{11}$ contains an alkyl group, an acyl group, a hydrazine group or a hydrazone group, or $R^{11}$ and $R^{12}$ may be combined to form a dihydropyridinium skeleton; moreover, at least one of the groups $R^{11}$, $R^{12}$ and $Z^{11}$ may have a group which promotes adsorption on silver halide; and $Y^{11}$ is a charge balancing counter ion and n is 0 or 1:

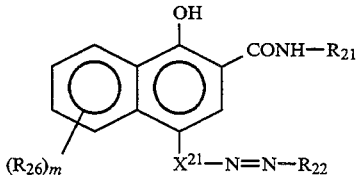

(IIa)

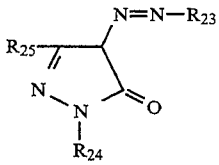

(IIb)

wherein $R_{21}$ and $R_{23}$ each represents an aliphatic group, an aromatic group, or a heterocyclic group; $R_{22}$ represents an aliphatic group, an aromatic group, or a heterocyclic group; $R_{25}$ represents an aniline group or an acylamino group; $R_{24}$ represents a substituted phenyl group; $X^{21}$ represents

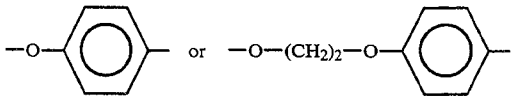

and $X^{21}$ may not exist; R26 represents a group which can be substituted on a benzene ring; and m represents an integer of 0 to 4.

2. The color photographic photosensitive material of claim 1, wherein $R_{25}$ represents:

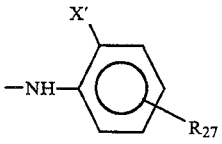

-continued

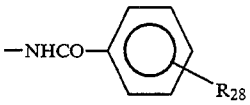

wherein X' represents a halogen atom or a substituted or unsubstituted alkoxy group; and $R_{27}$ and $R_{28}$ represent a hydrogen atom, a halogen atom, an alkyl group, an alkoxy group, an acylamino group, a sulfonamido group, a sulfamoyl group, a carbamoyl group, a diacylamino group, an alkoxycarbonyl group, an alkoxysulfonyl group, an aryloxysulfonyl group, an alkanesulfonyl group, an arylsulfonyl group, an alkylthio group, an arylthio group, an alkyloxycarbonylamino group, an alkylureido group, an acyl group, a nitro group, a carboxyl group or a trichloromethyl group, which groups may be substituted or unsubstituted.

3. The color photographic photosensitive material of claim 1, wherein the total amount of the colored coupler of formula (IIa) and (IIb) is from 0.05 to 1.0 g/m$^2$ of material.

4. The color photographic photosensitive material of claim 1, wherein the total amount of the colored coupler of formula (IIa) and (IIb) is from 0.06 to 0.1 g/m$^2$ of material.

5. The color photographic photosensitive material of claim 1, wherein the peak wavelength in the spectral absorption spectrum of the colored coupler of formula (IIa) or (IIb) is from 400 nm to 560 nm.

6. The color photographic photosensitive material of claim 1, wherein the silver halide grains have not been pre-fogged.

7. The color photographic photosensitive material of claim 1, wherein one or more of $R^{11}$, $R^{12}$ and $Z^{11}$ has a substituent group represented by $X^1$-$(L^1)_m$-, where $X^1$ represents a group which promotes adsorption on silver halide, $L^1$ represents a divalent linking group, and m represents 0 or 1.

8. The color photographic photosensitive material of claim 1, wherein the colored coupler of formula (IIa) or (IIb) is added to a magenta color forming coupler containing layer , a cyan color forming coupler containing layer or an adjacent light-insensitive layer thereof.

9. The color photographic photosensitive material of claim 8, wherein hue of the colored coupler of formula (IIa) or (IIb) which is contained in a magenta color forming coupler containing layer is yellow.

10. The color photographic photosensitive material of claim 8, wherein hue of the colored coupler of formula (IIa) or (IIb) which is contained in a cyan color forming coupler containing layer is yellow and/or magenta.

11. The color photographic photosensitive material of claim 1, wherein the silver halide grain is a silver iodobromide or silver iodochlorobromide which contains not more than 10 mol % of iodine.

12. The color photographic photosensitive material of claim 11, wherein the silver halide grain is a monodisperse emulsion of which the variation coefficient is not more than 15%.

13. The color photographic photosensitive material of claim 1, wherein the compound of formula (I) is contained in an amount of $10^{-8}$ to $10^{-2}$ mol per mol of silver halide.

14. The color photographic photosensitive material of claim 1, wherein a backing layer which contains carbon or graphite is provided on the support.

15. The color photographic photosensitive material of claim 1, wherein the density of the backing layer is 0.5 to 1.5.

16. The photographic direct positive photosensitive material of claim 1, wherein $R_{22}$ in formula (IIa) represents an aliphatic group or an aromatic group.

* * * * *